US007034631B2

(12) United States Patent
Ono et al.

(10) Patent No.: US 7,034,631 B2
(45) **Date of Patent: *Apr. 25, 2006**

(54) SYMMETRIC MICROWAVE FILTER AND MICROWAVE INTEGRATED CIRCUIT MERGING THE SAME

(75) Inventors: Naoko Ono, Tokyo (JP); Keiichi Yamaguchi, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/064,003

(22) Filed: Feb. 24, 2005

(65) Prior Publication Data

US 2005/0184832 A1 Aug. 25, 2005

Related U.S. Application Data

(63) Continuation of application No. 10/397,258, filed on Mar. 27, 2003, now Pat. No. 6,876,270.

(30) Foreign Application Priority Data

Mar. 28, 2002 (JP) ..... P2002-092759

(51) Int. Cl.
*H01P 5/00* (2006.01)

(52) U.S. Cl. ..... 333/33; 333/161

(58) Field of Classification Search ..... 333/33, 333/161, 103, 104, 156, 164, 139; 324/76.58
See application file for complete search history.

(56) References Cited

U.S. PATENT DOCUMENTS

| | | | | |
|---|---|---|---|---|
| 4,311,970 | A | 1/1982 | Bert et al. | 331/107 |
| 4,427,938 | A | 1/1984 | Prevot | 324/76.58 |
| 4,733,203 | A | 3/1988 | Ayasli | 333/139 |
| 5,317,290 | A | 5/1994 | Jacomb-Hood | 333/164 |
| 6,455,880 | B1 | 9/2002 | Ono et al. | 333/33 |

FOREIGN PATENT DOCUMENTS

| | | |
|---|---|---|
| JP | 2000-151221 | 5/2000 |
| JP | 2000-174209 | 6/2000 |

OTHER PUBLICATIONS

Koichi Suzuki et al., "Compact ODU with Dielectric Diplexer for FWA (Fixed Wireless Access)," TSMMW2000 Technical Digest (Mar. 2000), pp. 129-132.

*Primary Examiner*—Linh My Nguyen
(74) *Attorney, Agent, or Firm*—Finnegan, Henderson, Farabow, Garrett & Dunner, L.L.P.

(57) ABSTRACT

A microwave filter is disposed on a substrate. The microwave filter is adapted for connecting a first microwave transmission line to a second microwave transmission line, configured such that a signal propagates from the first to second microwave transmission lines. The microwave filter encompasses a highpass component of filter disposed in a symmetrical configuration with respect to a median plane placed perpendicular to the surface of the substrate, including the central axis of the first and second microwave transmission lines; and a lowpass component of filter connected parallel with the highpass component of filter, the lowpass component of filter being disposed in a symmetrical configuration with respect to the median plane.

20 Claims, 13 Drawing Sheets

SYMMETRIC MICROWAVE FILTER AND MICROWAVE INTEGRATED CIRCUIT MERGING THE SAME

CROSS REFERENCE TO RELATED APPLICATIONS

This application claims benefit of priority under 35 USC 119 based on Japanese Patent Application No. 2002-092759 filed Mar. 28, 2002, the entire contents of which are incorporated by reference herein.

This is a continuation of application Ser. No. 10/397,258, filed Mar. 27, 2003 now U.S. Pat. No. 6,876,270, which is incorporated herein by reference.

BACKGROUND OF THE INVENTION

1. Field of the Invention

The instant invention relates to high frequency circuits operating in microwave band, millimeter wave band, and particularly to a configuration of a microwave integrated circuit (MIC) or a monolithic microwave integrated circuit (MMIC). The invention particularly relates to a microwave filter, which can be employed in the MIC or the MMIC.

2. Description of the Related Art

In these years, it becomes urgent to increase communication channel numbers by rapid growth of informations demanded in the field of information communication. Therefore, the practical communication systems operating in the microwave/millimeter band, which were not used an earlier time, are now being promoted rapidly. As for the RF portion of the microwave communication apparatus, RF circuits such as a RF generator, a RF synthesizer, a RF modulator, a RF power amplifier, a RF low-noise amplifier, a RF demodulator, and a RF antenna are incorporated therein, generally. For the communication apparatus, the achievement of superior electric characteristics and miniaturized size is the principal objective of the research and development. For the achievement of the miniaturization of a RF portion, it is necessary to integrate RF circuitry. Therefore, the implementations of the MICs or the MMICs are considered to be effective.

Integration of the RF circuitry on a semiconductor chip has been developed with the rapid evolution of the semiconductor integration techniques. The circuitry merged in a semiconductor chip has been changed from an earlier discrete active element to a functional circuit block, which can serve as one of the RF circuitry of the communication apparatus. Further, the degree of on-chip integration has increased so that plural functional circuit blocks are merged into one semiconductor chip. In the MIC or the MMIC, active elements such as high electron mobility transistors (HEMTs), hetero junction bipolar transistors (HBTs), Schottky gate field effect transistors (MESFETs) as well as the passive elements such as capacitors (Cs), inductors (Ls), and resistors (Rs) are integrated. To implement the high frequency circuits, being merged into the MMIC, filters are often employed for the purpose of removing unnecessary signals from a targeted signal. In the RF circuitry, microwave filters are often employed for removing unnecessary signals from the RF signals, which are scheduled to be transferred into the IF circuitry.

However, earlier microwave filters have manifested poor performance, showing high transmission loss in a frequency range higher than cut-off frequency fc. The poor performance is ascribable to the phenomena that high frequency current is easy to flow an edge of filter, and thereby the current crowding is generated to dissipate high frequency powers.

SUMMARY OF THE INVENTION

In view of these situations, it is an object of the present invention to provide a microwave filter and a microwave integrated circuit using the microwave filter, which can control distribution of high frequency current so as to suppress the generation of the current crowding at the edge of the microwave filter, thereby achieving a high performance.

To achieve the above-mentioned objects, a feature of the present invention inheres in a microwave filter disposed on a substrate, being adapted for connecting a first microwave transmission line to a second microwave transmission line, configured such that a signal propagates from the first to second microwave transmission lines, encompassing (a) a highpass component of filter disposed in a symmetrical configuration with respect to a median plane placed perpendicular to the surface of the substrate, including the central axis of the first and second microwave transmission lines, and (b) a lowpass component of filter connected parallel with the highpass component of filter, the lowpass component of filter being disposed in a symmetrical configuration with respect to the median plane.

Another feature of the present invention inheres in a microwave filter inserted in a microwave transmission line disposed on a substrate, encompassing (a) a highpass component of filter disposed on the substrate and (b) a lowpass component of filter disposed on the substrate. Here, topological distributions of the highpass and lowpass components of filter are approximately same in a mirror-image relationship with respect to a median plane, the median plane placed perpendicular to the surface of the substrate, including the central axis of the microwave transmission lines along a signal propagation direction, the topological distributions are defined on a cross-sectional plane, which is perpendicular to the signal propagation direction.

Still another feature of the present invention inheres in a microwave filter comprised of thin film elements, the microwave filter inserted in a microwave transmission line disposed on a substrate, encompassing (a) first and second highpass elements disposed on the opposite sides of a median plane respectively, the median plane placed perpendicular to the surface of the substrate, including the central axis of the microwave transmission lines along a signal propagation direction, and (b) a lowpass element disposed on the central axis of the microwave transmission line, being sandwiched by the first and second highpass elements with a gap width provided on both sides of the lowpass element, respectively. Here, topological distribution of the lowpass element is approximately same in a mirror-image relationship with respect to the median plane on a cross-sectional plane, the cross-sectional plane being defined as a plane perpendicular to the signal propagation direction.

Yet still another feature of the present invention inheres in a microwave filter comprised of thin film elements, the microwave filter inserted in a microwave transmission line disposed on a substrate, encompassing (a) first and second highpass elements disposed on the opposite sides of the median plane respectively, the median plane placed perpendicular to the surface of the substrate, including the central axis of the microwave transmission lines along a signal propagation direction, and (b) first and second lowpass elements disposed on the opposite sides of the median plane respectively, an arrangement of the first and second lowpass elements being sandwiched by the first and second highpass elements with a gap width provided on both sides of the arrangement of the first and second lowpass elements, respectively. Here, the arrangement of the first and second lowpass elements is approximately same in a mirror-image relationship with respect to the median plane on a cross-sectional plane, the cross-sectional plane being defined as a plane perpendicular to the signal propagation direction.

Yet still another feature of the present invention inheres in a microwave filter comprised of thin film elements, the microwave filter inserted in a microwave transmission line disposed on a substrate, encompassing (a) first and second lowpass elements disposed on the opposite sides of the median plane respectively, the median plane placed perpendicular to the surface of the substrate, including the central axis of the microwave transmission lines along a signal propagation direction, and (b) a highpass element disposed on the central axis of the microwave transmission line, being sandwiched by the first and second lowpass elements with a gap width provided on both sides of the highpass element, respectively. Here, topological distribution of the highpass element is approximately same in a mirror-image relationship with respect to the median plane on a cross-sectional plane, the cross-sectional plane being defined as a plane perpendicular to the signal propagation direction.

Yet still another feature of the present invention inheres in a microwave filter, the microwave filter inserted in a microwave transmission line disposed on a substrate, encompassing a lowpass thin film element and a highpass thin film element stacked on the lowpass thin film element. Here, topological distribution of a stacked structure comprised of the lowpass and highpass thin film elements is approximately same in a mirror-image relationship with respect to a median plane, the median plane placed perpendicular to the surface of the substrate, including the central axis of the microwave transmission lines along a signal propagation direction, the topological distribution is defined on a cross-sectional plane, which is perpendicular to the signal propagation direction.

Yet still another feature of the present invention inheres in a microwave integrated circuit encompassing (a) a substrate, (b) a first microwave transmission line implemented by the substrate, (c) a second microwave transmission line implemented by the substrate, configured such that a signal propagates from the first to second microwave transmission lines, (d) a highpass component of filter disposed in a symmetrical configuration with respect to a median plane placed perpendicular to the surface of the substrate, including the central axis of the first and second microwave transmission lines, the highpass component of filter is disposed on the substrate so that the first microwave transmission line is connected to the second microwave transmission line, and (e) a lowpass component of filter connected parallel with the highpass component of filter, the lowpass component of filter being disposed in a symmetrical configuration with respect to the median plane, the lowpass component of filter is disposed on the substrate so that the first microwave transmission line is connected to the second microwave transmission line.

Other and further objects and features of the present invention will become obvious upon an understanding of the illustrative embodiments about to be described in connection with the accompanying drawings or will be indicated in the appended claims, and various advantages not referred to herein will occur to one skilled in the art upon employing of the present invention in practice.

DETAILED DESCRIPTION OF THE EMBODIMENTS

Figure 1A:
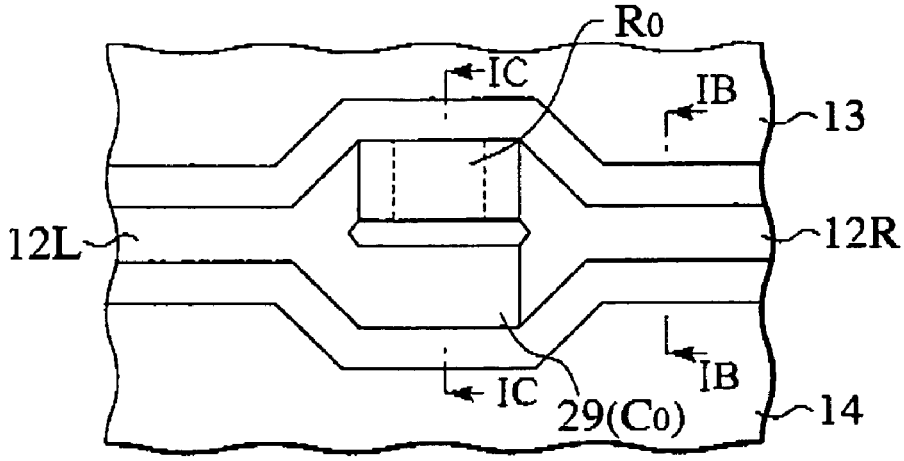
FIGS. 1A–1C are schematic views of an asymmetric microwave filter as an illustrative example.

Various embodiments of the present invention will be described with reference to the accompanying drawings. It is to be noted that the same or similar reference numerals are applied to the same or similar parts and elements throughout the drawings, and the description of the same or similar parts and elements will be omitted or simplified. Generally and as it is conventional in the representation of semiconductor devices, it will be appreciated that the various drawings are not drawn to scale from one figure to another nor inside a given figure, and in particular that the layer thicknesses are arbitrarily drawn for facilitating the reading of the drawings.

In the following description specific details are set fourth, such as specific materials, process and equipment in order to provide thorough understanding of the present invention. It will be apparent, however, to one skilled in the art that the present invention may be practiced without these specific details. In other instances, well-known manufacturing materials, process and equipment are not set forth in detail in order not unnecessary obscure the present invention. Prepositions, such as "on", "over", "under", and "perpendicular" are defined with respect to a planar surface of the substrate, regardless of the orientation the substrate is actually held. A layer is on another layer even if there are intervening layers.

Definition of Highpass and Lowpass Components

Microwave filter may rely on distributed-parameter elements. However, much of the analysis and many of the design procedure are applicable to lumped-parameter elements. Well-known passive circuits elements represented by the lumped-parameter elements are the capacitor C, inductor L and resistor R. As well known in the art, the capacitor C is characterized by a reactance in the sinusoidal regime:

$$jX_c = l/(j\omega C) \quad (1)$$

where f is the frequency and $\omega=2\pi f$. Eq. (1) means that more current flows in the capacitor C as the frequency f increases. Eq. (1) means further that the sinusoidal variation of current leads the sinusoidal variation of voltage. On the contrary, the inductor L is characterized by a reactance in the sinusoidal regime:

$$jX_L = j\omega L \quad (2)$$

Eq. (2) means that smaller current flows in the inductor L as the frequency f increases, lagging the sinusoidal variation of current in respect to the induced sinusoidal variation of voltage.

In the present Specification, the passive circuit elements represented by the lumped-parameter elements are categorized into highpass and lowpass components of filter. That is, as used hereinafter, "highpass component" shall mean the passive circuit element (component) in which more current flows in higher frequency range. The higher frequency ranges lies in the microwave range, which is generally defined in the art as the frequency range spanning from 300 MHz to 300 GHz. The capacitor C is categorized into the highpass component of filter. The single highpass component of filter can embrace a plurality of parallel-connected passive circuit elements. That is, the single highpass component of filter can embrace a plurality of parallel-connected highpass elements, which serve as filter elements, respectively. A single capacitor C is categorized into the highpass element of the filter. The highpass element is one of the filter elements implementing the highpass component of filter.

And, as used hereinafter, "lowpass component" shall mean the passive circuit element (component) in which smaller current flows in the higher frequency range. The inductor L and the resistor R are categorized into the lowpass component of filter. Anyhow, any conductive strip including resistor R can have inductive component in the microwave range, as taught by the Maxwell's Equations. Actually, the non-capacitive elements including resistive element are categorized into the lowpass component of filter. The single lowpass component of filter can embrace a plurality of parallel-connected passive circuit elements. Namely, the single lowpass component of filter can embrace a plurality of parallel-connected lowpass elements, which serve as filter elements, respectively. A single inductor L and a single resistor R are categorized into the lowpass element of the filter, respectively. The lowpass element is one of the filter elements implementing the lowpass component of filter.

Asymmetric Microwave Filter

Figure 1B:
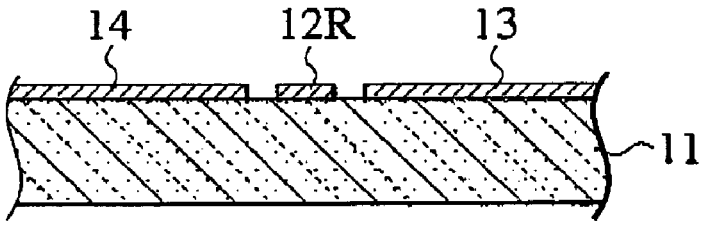
Figure 1C:
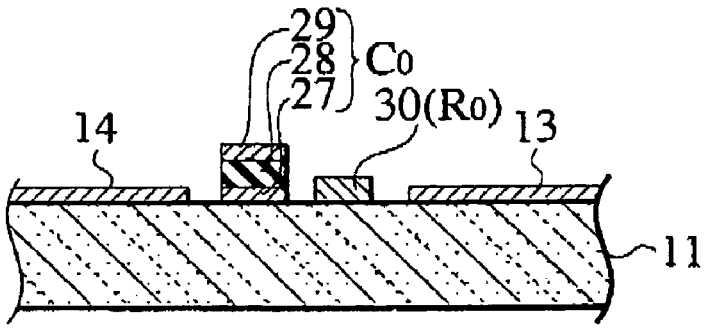

A top plan view of an asymmetric microwave filter integrated in an MMIC is shown in FIGS. 1A–1C as an illustrative example. FIG. 1B shows a sectional view taken on line IA—IA of FIG. 1A, and FIG. 1C shows a sectional view taken on line IB—IB of FIG. 1A.

As shown in FIGS. 1A–1C, the asymmetric microwave filter according to the illustrative example is integrated on a substrate 11 so that a first signal line 12L and a second signal line 12R run between a first gland plate 13 and a second gland plate 14, thereby implementing a coplanar waveguide (CPW) configuration. On the substrate 11, one capacitor (a capacitive element) $C_0$ (27, 28, 29) and one resistive element ($R_0$) 30, which is a non-capacitive element, are disposed so that total two elements implement one asymmetric microwave filter, the capacitor C0 and the resistive element $R_0$ are connected in parallel configuration. As shown in FIG. 1A, both ends of the first signal line 12L and the second signal line 12R forks into two branch lines. And among facing two sets of two branch lines, the capacitor $C_0$, which is categorized into a highpass component of filter, is interposed in the lower-branch line, the resistive element $R_0$ which is categorized into a lowpass component of filter (a non-capacitive element) is interposed in the upper-branch line, so that they are connected in parallel.

As shown in FIG. 1C, the capacitor $C_0$ encompasses an edge of the lower-branch line of the second signal line 12R of the CPW serves as a bottom electrode, and an edge of the lower-branch line of the first signal line 12L of the CPW serves as a top electrode of a MIM capacitor. In this MIM capacitor configuration, a capacitor dielectric film 28 is sandwiched in between the bottom electrode 27 and top electrode 29. On the other hand, the resistive element R0 is configured to connect an edge of the upper-branch line of the first signal line 12L with an edge of an upper-branch line of the second signal line 12R of the CPW by a resistor film 30.

Or, although the illustration is omitted, we can employ another configuration of the asymmetric microwave filter such that total two elements, consisting of a capacitor (a capacitive element) and an inductor (an inductive element) are connected in parallel on the substrate 11.

Figure 4A:
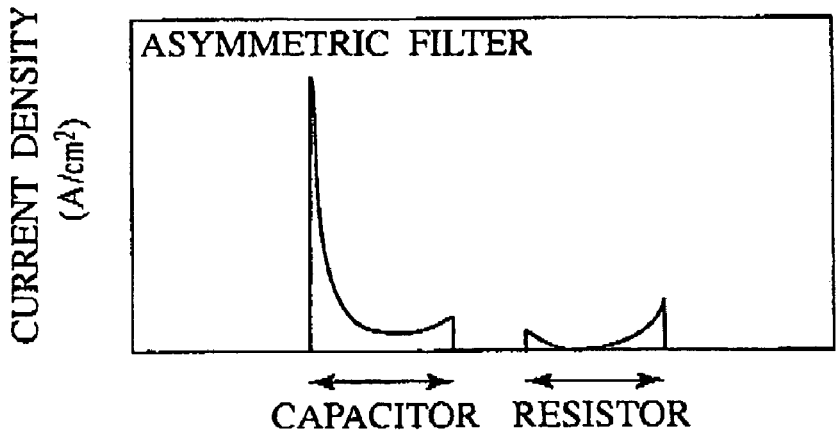
FIG. 4A is a diagram showing current density distribution of the asymmetric microwave filter.

In the configuration of the asymmetric microwave filter as shown in FIGS. 1A–1C, currents concentrates asymmetrically in regards of two edges of the asymmetric microwave filter as shown in FIG. 4A in frequency range higher than the cut-off frequency fc. The asymmetric currents concentration is ascribable to "an edge effect" of the RF current. Here, the assembly in which the capacitor $C_0$ and resistor element $R_0$ are connected in parallel is regarded as a lumped body. In FIG. 4A, because current is not easy to flow in the resistor portion, the current larger than that of flowing the edges of resistor portion flows asymmetrically at one of the edges of the capacitor portion. Similarly, in the asymmetric microwave filter having two elements, consisting of the capacitor (the capacitive element) and the inductor (the inductive element) arranged in parallel on the substrate, a large asymmetric current flows at one of edges of the capacitor than that flowing at both edges of inductor portion. When the asymmetric current crowding phenomena as shown in FIG. 4A occurs, a transmission loss becomes large.

First Embodiment

As shown in FIGS. 2A–2E, a microwave filter according to a first embodiment of the present invention is disposed on a substrate 11. The microwave filter is adapted for connecting a first microwave transmission line (12L, 13, 14) to a second microwave transmission line (12R, 13, 14), configured such that a signal propagates from the first microwave transmission line (12L, 13, 14) to the second microwave transmission line (12R, 13, 14). The microwave filter encompasses a highpass component (C1, C2) and a lowpass component (R) of filter connected parallel with the highpass component (C1, C2). The highpass component (C1, C2) of filter disposed in a symmetrical configuration with respect to a median plane IIM—IIM placed perpendicular to the surface of the substrate 11, the median plane IIM—IIM includes the central axis of the first microwave transmission line (12L, 13, 14) and second microwave transmission line (12R, 13, 14). The lowpass component (R) of filter is disposed in a symmetrical configuration with respect to the median plane IIM—IIM. The first microwave transmission line (12L, 13, 14) encompasses first signal line 12L, first gland pattern 13 and second gland pattern 14 sandwiching the first signal line 12L, assigning a constant gap width along both sides of the first signal line 12L so as to implement a first CPW. The second microwave transmission line (12R, 13, 14), encompasses a second signal line 12R running through the first gland pattern 13 and second gland pattern 14, assigning the constant gap width along both sides of the second signal line 12R so as to implement a second CPW.

Figure 2A:
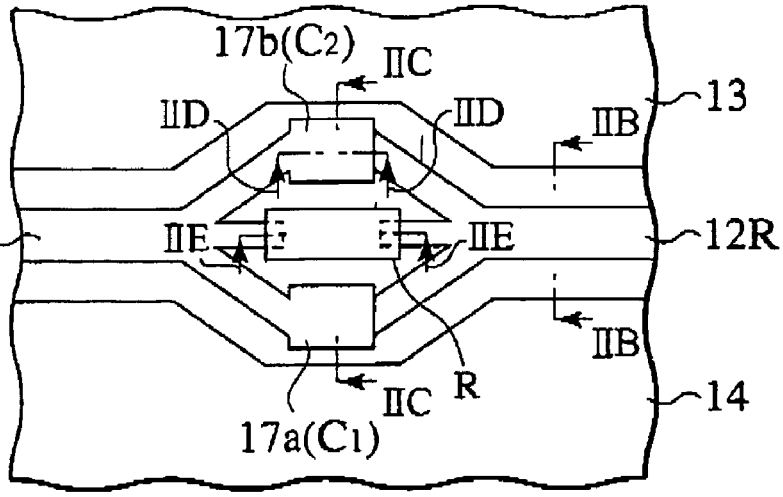
FIGS. 2A–2E are schematic views of a microwave filter according to a first embodiment of the present invention.

Namely, as shown in FIGS. 2A–2E, the microwave filter according to a first embodiment of the present invention is integrated in a CPW configuration disposed on a substrate 11. As shown in FIG. 2A, both of facing edges of the first signal line 12L and the second signal line 12R fork into three blanch lines, respectively. Among the three branch lines, a resistive element (a non-capacitive element) R is interposed in the central-branch line, the resistive element R is categorized into a lowpass component of filter. Among the three branch lines, a first capacitor (a capacitive element) C1 is interposed in the lower-branch line, the first capacitor C1 serves as a half part of a highpass component of filter. And among the three branch lines, a second capacitor (a capacitive element) C2 is interposed in the upper-branch line, the second capacitor C2 serves as remaining half part of the highpass component of filter. In this way, a symmetric configuration in which two capacitors (two capacitive elements) C1 and C2 and one resistive element (non-capacitive element) R are connected in parallel along the whole branch lines is implemented.

With respect to the central axis of the first signal line 12L and the second signal line 12R, the first capacitor (the capacitive element) C1 and the second capacitor (the capacitive element) C2 are disposed in upside down symmetry topology on the plan view of FIG. 2A. Because the resistive element R is disposed on the central axis, the microwave filter according to the first embodiment of the present invention has the symmetric topology with respect to the central axis of the central conducting strip of the CPW.

Figure 2B:
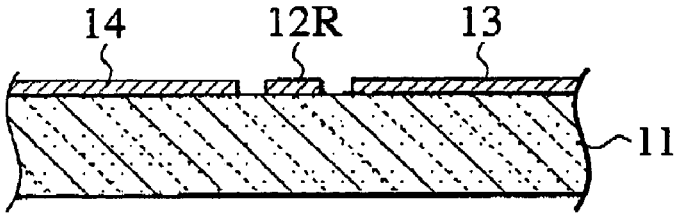
Figure 2C:
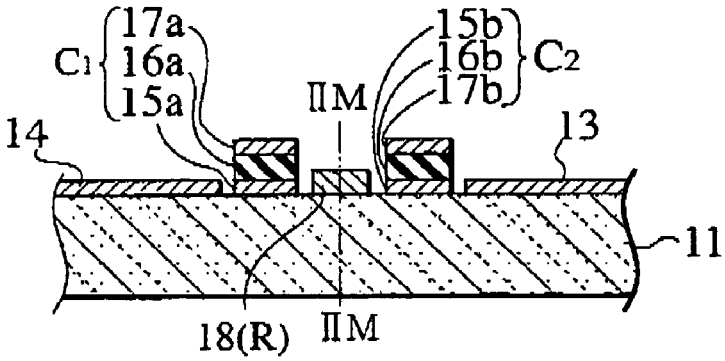

The geometrical configuration illustrated on the cross sectional view as shown in FIG. 2C is symmetry with respect to the median plane IIM—IIM. In the geometrical configuration, filter elements C1, C2 and R are connected in parallel along the signal propagation direction of the microwave transmission line. Namely, the cross section shown in FIG. 2C is perpendicular to the signal propagation direction along the central axis of the first signal line 12L and the second signal line 12R. The shape and relative position of the filter elements C1 and C2 disposed on the opposite sides of the median plane IIM—IIM has mirror-image relation along the median plane IIM—IIM. The topology of the filter element R disposed on the central axis of the first signal line 12L and the second signal line 12R has mirror-image relation with respect to the median plane IIM—IIM. In other word, the spatial distribution of the filter elements C1, C2 and R is symmetry about the median plane IIM—IIM.

Namely the microwave filter of the first embodiment is implemented by thin film elements (15*a*, 16*a*, 17*a*; 15*b*, 16*b*, 17*b*; 18), and is inserted in the microwave transmission line disposed on the substrate 11. Or the microwave filter is merged in the microwave transmission line. The first highpass element C1 and second highpass element C2 are disposed on the opposite sides of the median plane IIM—IIM respectively. The lowpass element R is disposed on the central axis of the microwave transmission line, and is sandwiched by the first highpass element C1 and second highpass element C2 with a gap width provided on both sides of the lowpass element R, respectively. Here, topological distribution of the lowpass element R is approximately same in a mirror-image relationship with respect to the median plane IIM—IIM on a cross-sectional plane, the cross-sectional plane being defined as a plane perpendicular to the signal propagation direction.

The width of the first signal line 12L and the second signal line 12R may be, for example, approximately 20 μm. And, the width of respective three branch lines can be chosen approximately 10 μm. In addition, for example, the spacing between the first gland plate 13 and the first signal line 12L, between the first gland plate 13 and the second signal line 12R, between the second gland plate 14 and the first signal line 12L, and between the second gland plate 14 can be designed as approximately 15 μm.

Figure 2D:
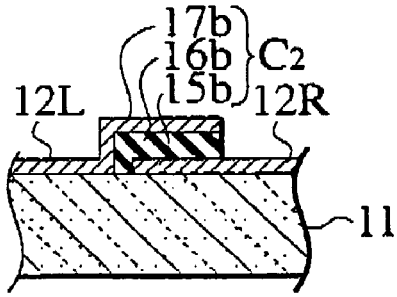
Figure 2E:
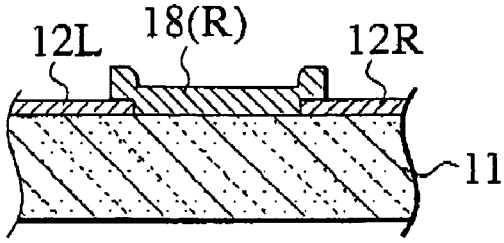

FIG. 2B is a sectional view taken on line IIA—IIA of FIG. 2A, FIG. 2C is a sectional view taken on line IIB—IIB of FIG. 2A. Furthermore, FIG. 2D is a sectional vies taken on line. IIC—IIC of FIG. 2A. FIG. 2E is a sectional view taken on line IID—IID of FIG. 2A. As substrate 11 used for the microwave filter according to the first embodiment, semi-insulating semiconductor substrates such as silicon (Si), gallium arsenide (GaAs) and indium phosphide (InP), ceramics substrate such as alumina ($Al_2O_3$), aluminum nitride (AlN), and beryllia (BeO), or insulating substrates such as resin can be employed. As resin substrate, epoxy resin reinforced by glass fiber (e-glass) can be employed. As a laminate material consisting of the epoxy resin and the glass fiber, the substrate of FR-4 grade, which is prescribed by American National Standard Institute (ANSI), is common. However, a semiconductor substrate is employed as the substrate 11 in the microwave filter according to the first embodiment. On the semiconductor substrate 11, gold (Au) thin films or aluminum (Al) thin films having thickness of 0.1–2 μm are disposed to implement the CPW configuration.

As shown in FIGS. 2C and 2D, the second capacitor (the capacitive element) C2 encompasses a bottom electrode 15*b* implemented by an edge of the branch line of the second signal line 12R of the CPW, a top electrode 17*b* implemented by an edge of the branch line of the first signal line 12L of the CPW, and a capacitor dielectric film 16*b* sandwiched in between the bottom electrode 15*b* and top electrode 17*b*, so as to implement a MIM capacitor configuration. For the capacitor dielectric film 16*b*, insulating film such as silicon oxide film ($SiO_2$ film) and silicon nitride film ($Si_3N_4$ film) can be used. As shown in FIG. 2C, the first capacitor (the capacitive element) C1 has the MIM capacitor configuration, encompassing a bottom electrode 15*a*, a top electrode 17*a* and a capacitor dielectric film 16*a* disposed between the bottom electrode 15*a* and the top electrode 17*a*. On the other hand, a resistive element R is implemented by a resistor body 18 configured to connect an edge of the central-branch line of the second signal line 12R of the CPW and an edge of the central-branch line of the first signal line 12L of the CPW, as shown in FIG. 2E. As suitable material for the resistor body 18 shown in FIG. 2E, platinum (Pt), tantalum nitride ($Ta_2N$), Ni—Cr alloy can be employed. In this way, the microwave filter according to the first embodiment embraces resistance R=15 Ω, capacitances C1=C2=0.5 pF, and the microwave filter can be adapted for an amplifier of a quasi-millimeter wave band of 20–30 GHz.

Figure 3:
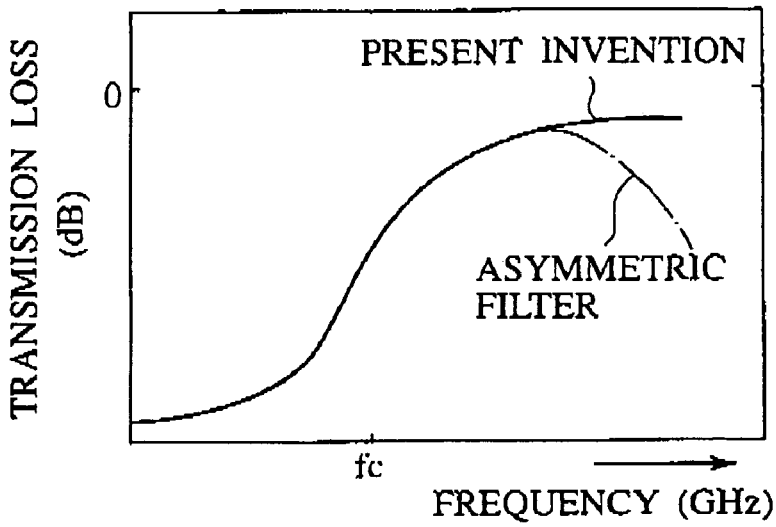
FIG. 3 explains frequency characteristics of the microwave filter according to the first embodiment of the present invention.

Frequency characteristics of the microwave filter consisting of one resistive element R and two capacitors (capacitive elements), which are merged in the CPW disposed on the surface of substrate 11, is shown in FIG. 3 in comparison with that of the asymmetric microwave filter shown in FIGS. 1A–1C.

Figure 4B:
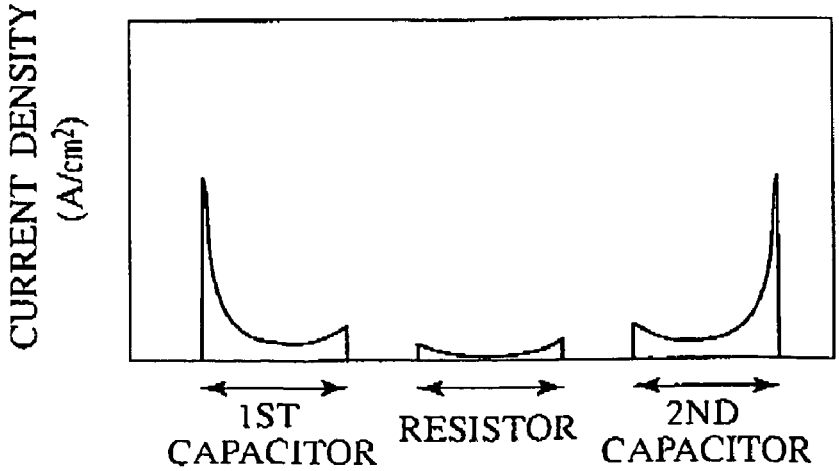
FIG. 4B is a diagram to showing current density distribution of the microwave filter according to the first embodiment.

FIG. 3 shows the microwave filter manifesting high performance with low transmission loss in a frequency range higher than cut-off frequency fc. The high performance is ascribable to the phenomena that high frequency current is easy to flow in a highpass component of filter implemented by the capacitor (capacitive element), but is hard to flow in a lowpass component of filter implemented by the resistive element R, and thereby the current crowding is reduced as shown in FIG. 4B. FIG. 4B shows the current density distribution in frequency range higher than cut-off frequency fc on the plane perpendicular to the signal propagation direction of the microwave filter consisting of two capacitors (capacitive elements) C1, C2 and one resistive element R. FIG. 4B shows that the symmetric behavior of the current density distribution is improved compared with that of the asymmetric microwave filter shown in FIG. 4A, and that the current crowding in the lowpass component of filter is reduced in the symmetric microwave filter according to the first embodiment.

Figure 5:
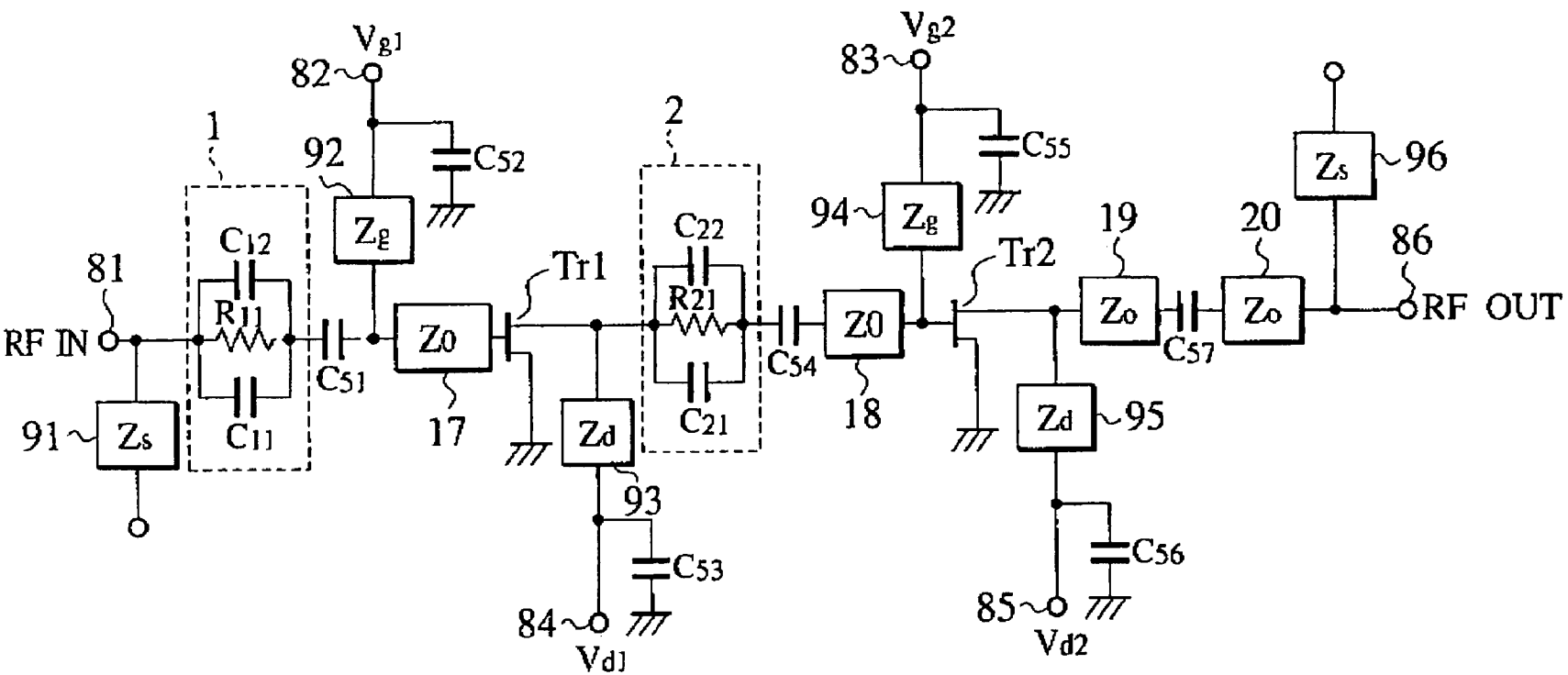
FIG. 5 is an equivalent circuit of a microwave integrated circuit according to the first embodiment of the present invention.

As shown in an equivalent circuit of FIG. 5, a microwave integrated circuit according to the first embodiment is a MMIC, encompassing two-stage high-frequency amplifier merged in a semiconductor substrate with the symmetric microwave filters. The two-stage high-frequency amplifier embraces a first transistor (a first active element) Tr1 and a second transistor (a second active element) Tr2. The MMIC amplifier according to the first embodiment encompasses two symmetric microwave filters, each consisting of two MIM capacitors (C11, C12; C21, C22) and one resistive element (R11 P21). One (C11, C12, R11) of the two microwave filters is disposed so as to implement an input matching circuit, and other (C21, C22, R21) is disposed so as to implement an inter stage matching circuit. To be concrete, as shown in the equivalent circuit of FIG. 5, a microwave transmission line integrates, on a path between a RF input terminal 81 and a RF output terminal 86, an input filter 1, a coupling capacitor C51, a first transistor Tr1, an inter stage filter 2, a coupling capacitor C54, a second transistor Tr2, and a coupling capacitor C57 in this order. The input filter 1 is a symmetric parallel circuit implementing the input matching circuit, the input filter 1 encompasses a first capacitor C11, a second capacitor C12, and a resistive element R11. The inter stage filter 2 is another symmetric parallel circuit implementing the inter stage matching circuit, the inter stage filter 2 encompasses a first capacitor C21, the second capacitor C22, and a resistive element R21. Then, RF signal fed to the RF input terminal 81 is transmitted through the microwave transmission lines, and finally is supplied from the RF output terminal 86 to outside circuitry.

Between the input filter 1 and the RF input terminal 81, an open stub of impedance Zs configured to adjust impedance of the microwave transmission line is disposed so as to implement the input matching circuit. A source electrode of the first transistor Tr1 is grounded. To a gate electrode of the first transistor Tr1, a DC gate bias voltage Vg1 is supplied through a bypass capacitor (decoupling capacitor) C52 configured to separate direct current from high frequency current and through an impedance element Zg from a DC bias terminal 82. To a drain electrode of the first transistor Tr1, a DC drain bias voltage Vd1 is supplied through a bypass capacitor (decoupling capacitor) C53 configured to separate direct current from high frequency current and through an impedance element Zd from a DC bias terminal 84. Similarly, a source electrode of the second transistor Tr2 is grounded. To a gate electrode of the second transistor Tr2, a DC gate bias voltage Vg2 is supplied through a bypass capacitor C55 and through an impedance element Zg from a DC bias terminal 83. To a drain electrode of the second transistor Tr2, a DC drain bias voltage Vd2 is supplied through a bypass capacitor C56 and through an impedance element Zd from a DC bias terminal 84.

In this way, a RF signal is transferred to the first transistor Tr1 through the input filter 1 and a coupling capacitor C51 from the RF input terminal 81, and the first transistor Tr1 amplifies the RF signal. The amplified RF signal is transferred to the second transistor Tr2 through the inter stage filter 2 and a coupling capacitor C54, and the amplified RF signal is further amplified by the second transistor Tr2. And, through a coupling capacitor C57, the further amplified RF signal is transferred to the RF output terminal 86 so that the RF signal is provided to outside of the MMIC. Between the coupling capacitor C57 and the RF output terminal 86, an open stub 96 implementing an impedance Zs configured to adjust an impedance of the microwave transmission line is inserted. In addition, in FIG. 5, impedance elements ($Z_0$s) 18, 19, 20 are implemented by conducting strips respectively.

Figure 6:
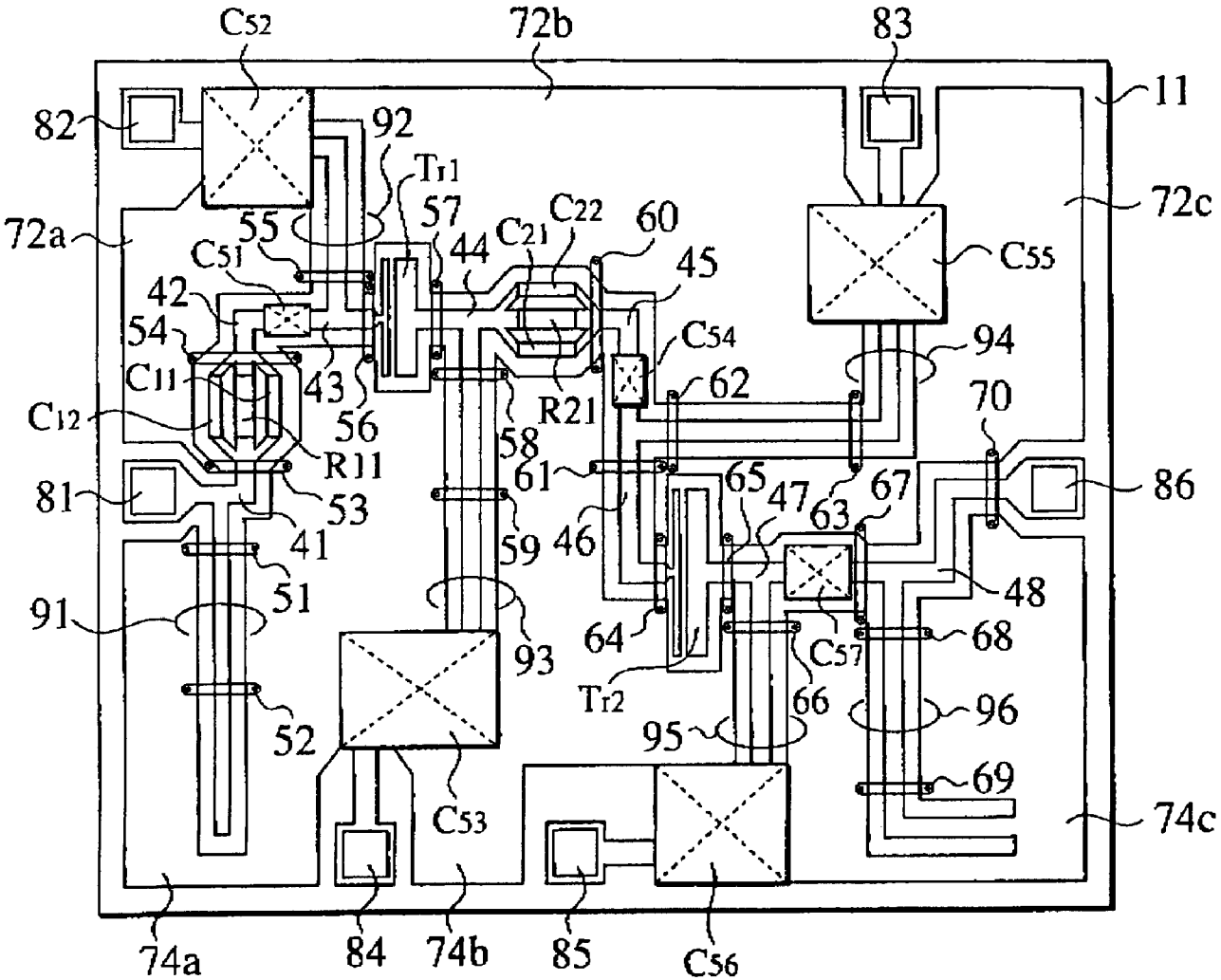
FIG. 6 is a plan view of the microwave integrated circuit according to the first embodiment of the present invention.

A configuration in which the first transistor Tr1, the second transistor Tr2, matching circuits, and bias circuits are integrated on the semiconductor substrate 11 is shown in a schematic plan view of FIG. 6. On the semiconductor substrate 11, the first grand patterns 72*a*, 72*b*, 72*c* and the second grand patterns 74*a*, 74*b*, 74*c* are disposed, and between these gland patterns, signal lines 41, 42, 43, . . . , 48 are inserted so as to implement the CPWs, or the microwave transmission lines.

For example, in FIG. 6, the first transistor Tr1 and the second transistor Tr2 can be implemented by high electron mobility transistors (HEMTs) formed in semi-insulating GaAs substrate 11. Firstly, when we focus to the second transistor Tr2 serving as the active element, the microwave integrated circuit according to the first embodiment encompasses the substrate 11 (the semiconductor substrate 11): the first grand patterns 72*a*, 72*b*, 72*c* disposed on the substrate 11, and the second gland patterns 74*b*, 74*c* disposed on the substrate 11 so as to face to the first grand patterns 72*a*, 72*b*, 72*c* with a predetermined gap width. Between the first grand patterns 72*a*, 72*b*, 72*c* and the second gland patterns 74*b*, 74*c*, a first main electrode (a source ohmic electrode), a second main electrode (a drain ohmic electrode) and a control electrode (a gate electrode) are inserted so as to implement the active element (the second transistor Tr2) on the semiconductor substrate 11. Further the microwave integrated circuit according to the first embodiment encompasses an input side signal line 46 being connected to the control electrode (the gate electrode) inserted between the first grand patterns 72*b*, 72*c* and the second grand pattern 74*b* on the semiconductor substrate 11: an output side signal line 47 being connected to the second electrode (the drain ohmic electrode) inserted between the first grand pattern 72*c* and the second grand patterns 74*b*, 74*c* on the semiconductor substrate 11; an input side DC bias stub 94 being connected to the input side signal line 46 inserted between the first grand patterns 72*b* and 72*c* on the semiconductor substrate 11; and an output side PC bias stub 95 being connected one edge of the output side signal line 47 inserted between the second grand patterns 74*b* and 74*c* on the semiconductor substrate 11.

Secondary, focusing to the first transistor Tr1 serving as another active element, the microwave integrated circuit according to the first embodiment encompasses the substrate 11; the first grand patterns 72*a*, 72*b* disposed on the substrate 11, and the second gland pattern 74*a* disposed on the substrate 11 so as to face to the first grand patterns 72*a*, 72*b* with a predetermined gap width. Between the first grand pattern 72*b* and the second gland pattern 74*a*, a first main electrode (a source ohmic electrode) a second main electrode (a drain ohmic electrode) and a control electrode (a gate electrode) are inserted so as to implement the active element (the first transistor Tr1) on the semiconductor substrate 11. Further, the microwave integrated circuit according to the first embodiment encompasses an input side signal line 43 being connected to the control electrode (the gate electrode) inserted between the first grand patterns 72*a*, 72*b* and the second grand pattern 74*a* on the semiconductor substrate 11; an output side signal line 44 being connected to the second electrode (the drain ohmic electrode) inserted between the first grand patterns 72*b* and the second grand patterns 74*a*, 74*b* on the semiconductor substrate 11; an input side DC bias stub 92 being connected to the input side signal line 43 inserted between the first grand patterns 72*a* and 72*b* on the semiconductor substrate 11; and an output side DC bias stub 93 being connected to the output side signal line 44 inserted between the second grand patterns 74*a* and 74*b* on the semiconductor substrate 11.

The coupling capacitors C51, C54 and C57 shown in FIG. 5 and FIG. 6 are implemented by MIM capacitors, respectively. Similarly, the bypass capacitors C52, C53 and C55 shown in FIG. 5 and FIG. 6 are implemented by the MIM capacitors, respectively. The input filter 3, the coupling capacitor C51, the inter stage filter 2 serve as circuit elements of the microwave transmission line simultaneously.

An intermediate signal line 42 is connected to the input side signal line 43 of the first transistor Tr1 serving as the active element, through the input filter 1 an input port signal line 41 is connected to the intermediate signal line 42, and the RF input terminal 81 is connected to the input port signal line 41. With a constant gap width assigned along both sides of the input port signal line 41, the input filter 1, the intermediate signal line 42 and the input side signal line 43, the first gland patterns 72*a*, 72*b* and the second gland pattern 74*a* are disposed so as to implement the first CPW (the input side CPW) of the first transistor Tr1. The source ohmic electrode of the first transistor Tr1 is divided into two wings, which sandwiches a gate-extracting electrode portion of the first transistor Tr1. The gate-extracting electrode portion is delineated as a T-shaped geometry, as shown in plan view. And the two source ohmic electrode wings are connected to the first grand pattern 72*b* and the second gland pattern 74*a*, respectively so as to be grounded.

Assigning the constant gap width along both sides of the output side signal line 44, the inter stage filter 2, and the output side signal line 43, the first gland pattern 72*b* and the second gland patterns 74*a*, 74*b* are disposed so as to implement the second CPW (the output side CPW) of the first transistor Tr1. Assigning the constant gap width along both sides of the input side signal line 46 connected to the gate electrode of the second transistor Tr2, the first gland patterns 72*b*, 72*c* and the second gland pattern 74*b* are disposed so as to implement the first CPW (the input side CPW) of the second transistor Tr2. A joint CPW is implemented by the second CPW (the output side CPW) of the first transistor Tr1 and the first CPW (the input side CPW) of the second transistor Tr2. A MIM capacitor is interposed between the output side signal line 44 of the first transistor Tr1 and the input side signal line 46 of the second transistor Tr2.

The source ohmic electrode of the second transistor Tr2 is divided into two wings, which sandwiches a gate-extracting electrode portion of the second transistor Tr2. The gate-extracting electrode portion is delineated as a T-shaped geometry shown in plan view. And the two source ohmic electrode wings are connected to the first grand pattern 72*c* and the second gland pattern 74*b*, respectively so as to be grounded.

Assigning the constant gap width along both sides of the output side signal line 47, the first gland pattern 72*c* and the second gland patterns 74*b*, 74*c* are disposed so as to implement the second CPW (the output side CPW) of the second transistor Tr2. Furthermore, through an MIM capacitor C57, an output port signal line 48 is connected to an output side signal line 47, which is connected to the drain electrode of the second transistor Tr2. The RF output terminal 86 is connected to the output port signal line 48. With the constant gap assigned along both sides of the output port signal line 48, the first grand pattern 72*c* and the second gland pattern 74*c* are disposed so as to implement the CPW.

The line width of the signal lines implementing the CPW can be chosen approximately 20 μm. And, with a gap width of about 15 μm assigned along both sides of these signal lines 41, 42, 43, . . . , 48, the first gland patterns 72*a*, 72*b*, 72*c* and the second gland patterns 74*a*, 74*b*, 74*c*, both having a width of approximately 250–500 μm, can be disposed so as to sandwich the signal lines 41, 42, 43, . . . , 48. The signal lines 41, 42, 43, . . . , 48, the first gland patterns 72*a*, 72*b*, 72*c* and the second gland patterns 74*a*, 74*b*, 74*c* are implemented by gold (Au) thin film having a thickness 0.1–3 μm. If the semiconductor substrate 11 is semi-insulating substrate 11, the Au thin film can be deposited on the semi-insulating substrate 11 directly. If the semiconductor substrate 11 is electrically conductive substrate 11, on the electrically conductive substrate 11, an insulating film such as silicon oxide ($SiO_2$ film), silicon nitride film ($Si_3N_4$ film) is deposited firstly on the insulating film, and thereafter the Au thin film will be deposited so as to implement the signal lines 41, 42, 43, . . . , 48, the first gland patterns 72*a*, 72*b*, 72*c* and the second gland patterns 74*a*, 74*b*, 74*c*.

As shown in FIG. 6, RF component of the output side DC bias stub 95 connected to the drain electrode of the second transistor Tr2 is short-circuited by the MIM capacitor C56, and the output side DC bias stub 95 is connected to a DC bias terminal 85 adapted for supplying drain voltage Vd2. The second CPW of the second transistor Tr2 encompasses the signal line and the second grand patterns 74*b* and 74*c*, which sandwich the signal line. RF component of the input side DC bias stub 94 connected to the gate electrode of the second transistor Tr2 is short-circuited by the MIM capacitor C55, and the input side DC bias stub 94 is connected to a DC bias terminal 83 adapted for supplying gate voltage Vg2. The input side DC bias stub 94 is the first CPW of the second transistor Tr2 embracing the signal line and the first grand patterns 72*b* and 72*c*, which are disposed so as to sandwich the signal line. RF component of the output side DC bias stub 93 connected to the drain electrode of the first transistor Tr1 is short-circuited by the MIM capacitor C53, and the output side DC bias stub 93 is connected to a DC bias terminal 84 adapted for supplying drain voltage Vd1. The output side DC bias stub 93 is the second CPW of the first transistor Tr1 embracing the signal line and the second grand patterns 74*a* and 74*b*, which are disposed so as to sandwich the signal line. RF component of the input side DC bias stub 92 connected to the gate electrode of the first transistor Tr1 is short-circuited by the MIM capacitor C52, and the input side DC bias stub 92 is connected to a DC bias terminal 82 adapted for supplying gate voltage Vg1. The input side DC bias stub 92 is the first CPW of the first transistor Tr1 embracing the signal line and the first grand patterns 72*a* and 72*b*, which are disposed so as to sandwich the signal line.

Furthermore, an open stub 91 serving as the impedance-adjustment stub is connected to the intermediate signal line 41, which is connected to the RF input terminal 81.

The impedance-adjustment stub (the open stub) 91 is the CPW embracing the signal line and the divided first grand patterns 72*a* and 72*a*, the divided first grand patterns 72*a* and 72*a* are disposed so as to sandwich the signal line. The input matching circuit of the first transistor Tr1 is implemented by a MIM capacitor C51 and the open stub 91. Furthermore, an open stub 96 as another impedance-adjustment stub is connected to the output port signal line 48, which is connected to the RF output terminal 86. The impedance-adjustment stub (the open stub) 96 is the CPW embracing the signal line and the divided second grand patterns 72*c* and 72*c*, the divided first grand patterns 72*c* and 72*c* are disposed so as to sandwich the signal line. The output matching circuit of the second transistor Tr2 is implemented by a MIM capacitor C57 and the open stub 96. In addition, each of the input side DC bias stubs 92 to 95 implemented by the CPWs plays the role of the matching circuit, simultaneously.

And, above the input port signal line 41, the intermediate signal line 42 and the input side signal line 43, through a thin dielectric film, although the illustration of which is omitted, bridge strips 53, 54, 56 made of Au metal pattern of approximately 3 μm thick, and approximately 10–50 μm wide are provided respectively. Furthermore, above the output side signal line 44, the output side signal line 45 and the input side signal line 46, through the illustration-omitted thin dielectric film, bridge strips 57, 60, 61 are provided respectively. Still furthermore, above the output side signal line 47 and the output side signal line 48, through the illustration-omitted thin dielectric film, bridge strips 65, 67, 70 are provided respectively. In this way, the bridge strips 51 to 70 are arranged in the CPW architecture so as to span over the signal lines with appropriate spacing. Through the bridge strips 51 to 57, the electric potential of the first grand patterns 72*a*, 72*b*, 72*c* is set to be equal to that of the second gland patterns 74*a*, 74*b*, 74*c*. The impedance elements ($Z_0$s) 17 to 20 shown in FIG. 5 include characteristic impedance of coaxial lines implemented by these bridge strips 51 to 70 erected over the signal lines, respectively.

By using the microwave filter as shown in FIGS. 2A–2E, the MMIC amplifier according to the first embodiment can reduce ripple parameter for the allowable pass-band ripple in the bandwidth.

Modification of First Embodiment

Figure 7A:
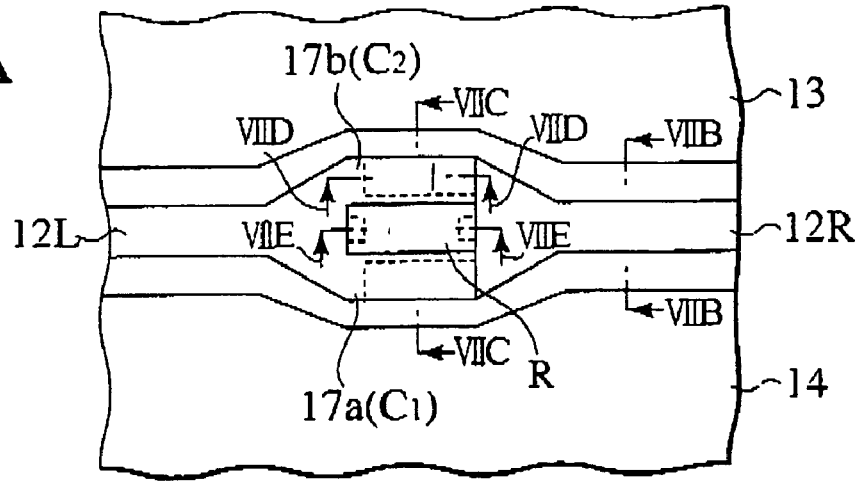
FIGS. 7A–7E are schematic views of a microwave filter according to a modification of the first embodiment of the present invention.
Figure 7B:
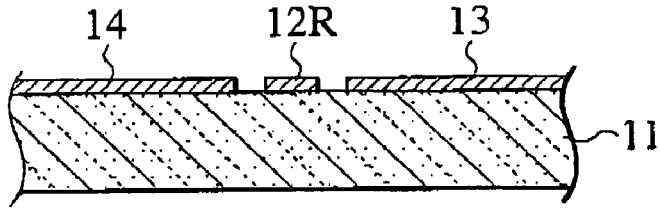
Figure 7C:
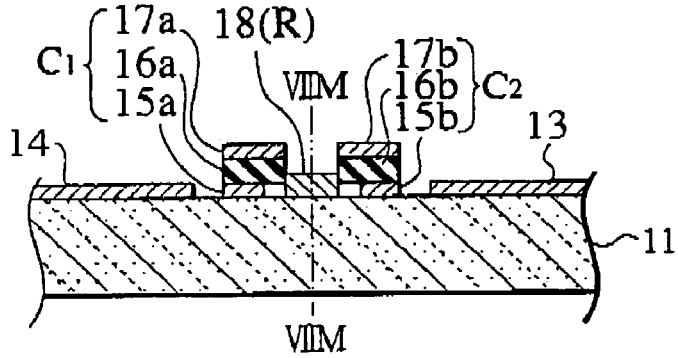
Figure 7D:
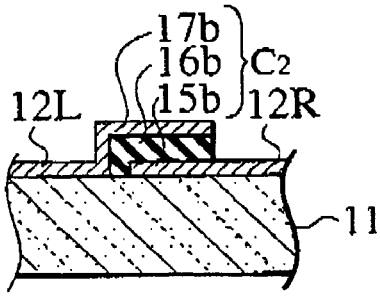
Figure 7E:
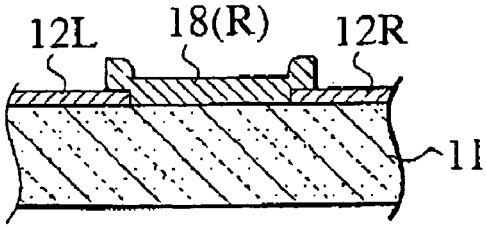

A top plan view of the microwave filter according to a modification of the first embodiment is shown in FIG. 7A. FIG. 7B is a sectional view taken on line VIIA—VIIA of FIG. 7A, and FIG. 7C is a sectional view taken on line VIIB—VIIB of FIG. 7A. Furthermore, FIG. 7D is a sectional view taken on line VIIC—VIIC of FIG. 7A, and FIG. 7E is a sectional view taken on line VIID—VIID of FIG. 7A. The feature of the configuration shown in FIGS. 7A–7E differs from that of FIGS. 2A–2E in that the first capacitor (the capacitive element) C1, the second capacitor (the capacitive element) C2 and the resistive element R are assembled into one piece without clearance in the configuration such that the resistive element R is inserted between the first capacitor (the capacitive element) C1 and the second capacitor (the capacitive element) C2, along the direction parallel to the surface of the substrate 11. As shown in FIG. 7C, there is a gap between a bottom electrode 15*a* of the first capacitor (the capacitive element) C1 and a side surface of resistor implementing the resistive element R so as to protect the short circuit failure between the bottom electrode 15*a* and the resistive element R. Similarly, there is a gap between a bottom electrode 15*b* of the second capacitor (the capacitive element) C2 and other side surface of resistor implementing the resistive element R so as to protect the short circuit failure between the bottom electrode 15*b* and the resistive element R. Under such requirement, the side surface of the resistive element R tightly contacts with a capacitor dielectric film 16*a* of the first capacitor (the capacitive element) C1, the other side surface of the resistive element R tightly contacts with a capacitor dielectric film 16*b* of the second capacitor (the capacitive element) C2. In this way, the geometrical configuration illustrated on the cross sectional view as shown in FIG. 7C is symmetry with respect to the median plane VIIM—VIIM, which is placed perpendicular to the surface of the substrate 11, the median plane VIIM—VIIM includes the central axis of the first signal line 12L and the second signal line 12R. In the geometrical configuration, filter elements C1, C2 and R are connected in parallel along the signal propagation direction of the microwave transmission line. Namely, the cross section shown in FIG. 7C is perpendicular to the signal propagation direction along the central axis of the first signal line 12L and the second signal line 12R. The shape and relative position of the filter elements C1 and C2 disposed on the opposite sides of the median plane VIIM—VIIM has mirror-image relation along the median plane VIIM—VIIM. The topology of the filter element R disposed on the central axis of the first signal line 12L and the second signal line 12R has mirror-image relation with respect to the median plane VIIM—VIIM. In other word, the spatial distribution of the filter elements C1, C2 and R is symmetry about the median plane VIIM—VIIM.

By using the configuration shown in FIGS. 7A–7E, the difference of line width of the transmission line and that of filter formation portion can be reduced so that the discontinuity caused by difference of signal line width of the filter and the transmission line can be minimized.

Although the illustration is omitted, the microwave filter shown in FIGS. 7A–7E implements similar microwave integrated circuit as shown in FIGS. 5 and 6.

Second Embodiment

The feature of the microwave filter according to a second embodiment is different from that of the microwave filter explained in the first embodiment differs in that one capacitor (the capacitive element) and one resistive element R are stacked along a perpendicular direction to the surface of the substrate 11.

Figure 8A:
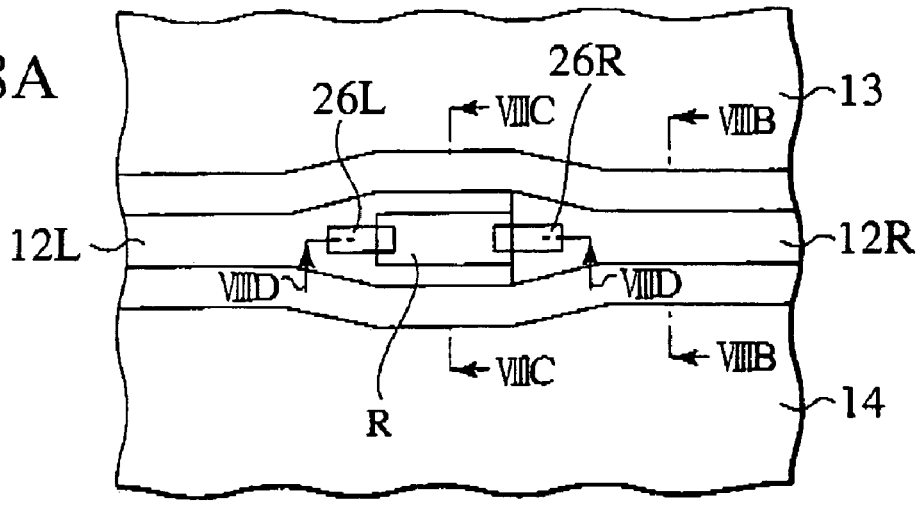
FIGS. 8A–8D are schematic views of the microwave filter according to the second embodiment of the present invention.

As shown in FIGS. 8A–8D, the microwave filter according to the second embodiment of the present invention is integrated in a CPW configuration encompassing a first signal line 12L, a second signal line 12R, a first gland plate 13 and a second gland plate 14, in which the first signal line 12L and the second signal line 12R run between the first gland plate 13 and the second gland plate 14. As shown in FIG. 8A, respective end portions of the first signal line 12L and the second signal line 12R are formed wider than the other portions serving as the central conducting strips of the CPWs. The capacitor (the capacitive element) C serving as a highpass component of filter is disposed on the wide end portions of the signal lines so as to bridge the facing wide end portions. And the resistive element R serving as a lowpass component of filter is stacked on the capacitor C so as to achieve a vertically stacked architecture, implementing a parallel circuit along a direction perpendicular to the surface of the substrate 11. In this parallel connection architecture along the direction perpendicular to the surface of the substrate 11, the microwave filter embracing the capacitor C and the resistive element R has a symmetric topology with respect to the central axis of the first signal line 12L and the second signal line 12R implementing the CPW. For example, as explained in the first embodiment, the line width of first signal line 12L and the second signal line 12R is set to be approximately 20 μm, but the facing wide end portions where the microwave filter is integrated can be chosen as approximately 25 μm to 30 μm.

Figure 8B:
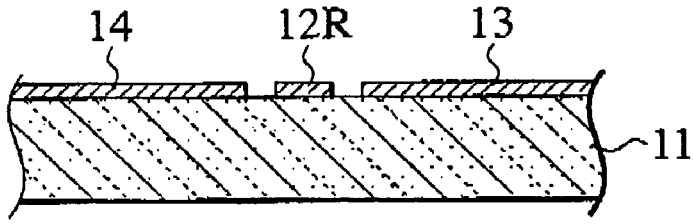
Figure 8C:
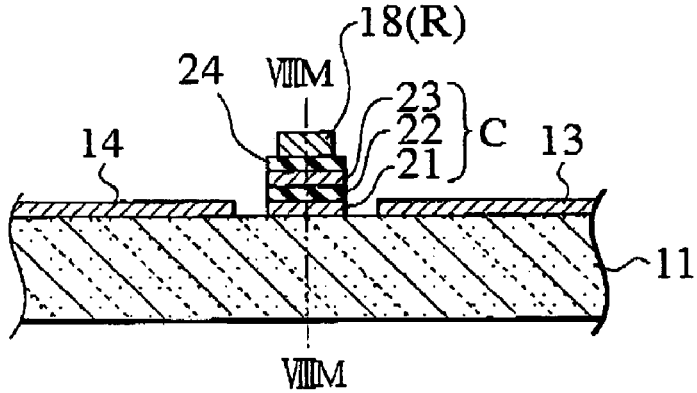
Figure 8D:
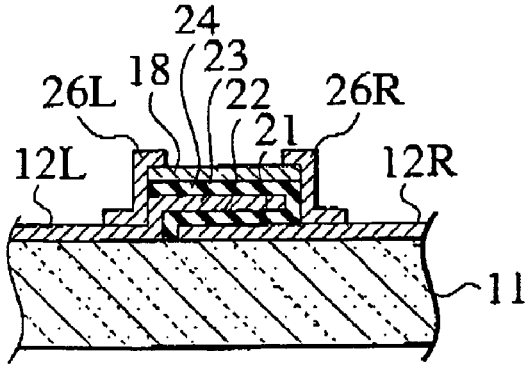

FIG. 8B is a sectional view taken on line VIIIA—VIIIA of FIG. 8A, and FIG. 8C is a sectional view taken on line VIIIB—VIIIB of FIG. 8A respectively. Furthermore, a sectional view taken on line VIIID—VIIID of FIG. 8A is shown in FIG. 8D. As a substrate 11 suitable for the microwave filter according to the second embodiment of the present invention, similar to the first embodiment, a semiconductor substrate 11, a ceramics substrate 11, or an insulating substrate 11 can be employed. However, the semiconductor substrate 11 is employed for the substrate 11 here, for example. As shown in FIGS. 8C and 8*b*, the capacitor (capacitive element) C encompasses a bottom electrode 21 implemented by the edge of the second signal line 12R of the CPW, a top electrode 23 implemented by an edge of the first signal line 12L of the CPW, and a capacitor dielectric film 22 sandwiched in between the bottom electrode 21 and the top electrode 23, so as to implement a MIM capacitor configuration. For the capacitor dielectric film 22, insulating film such as $SiO_2$ film and $Si_2N_4$ film can be used.

The geometrical configuration illustrated on the cross sectional view as shown in FIG. 8C is symmetry with respect to the median plane VIIIM—VIIIM, which is placed perpendicular to the surface of the substrate 11, the median plane VIIIM—VIIIM includes the central axis of the first signal line 12L and the second signal line 12R. In the geometrical configuration, the vertically stacked filter elements C and R are connected in parallel along the signal propagation direction of the microwave transmission line. Namely, the cross section shown in FIG. 8C is perpendicular to the signal propagation direction along the central axis of the first signal line 12L and the second signal line 12R. The topology of the vertically stacked filter elements C and R disposed on the central axis of the first signal line 12L and the second signal line 12R has mirror-image relation with respect to the median plane VIIIM—VIIIM. In other word, the spatial distribution of the vertically stacked filter elements C and R is symmetry about the median plane VIIIM—VIIIM.

On the other hand, on an inter-layer insulation film made of $SiO_2$ film and/or $Si_3N_4$ film disposed on the top electrode 23, a resistor body 18 is deposited so as to implement the resistive element R, connecting through a connection conducting strip 26R with an edge of the second signal line 12R of the CPW, and connecting through a connection conducting strip 26L with an edge of the first signal line 12L of the CPW, as shown in FIG. 8P. AS suitable material for the connection conducting strips 26R and 26L, Au thin film or Al thin film can be employed. And as suitable material for the resistor body 18, Pt, $Ta_2N$, or Ni—Cr alloy can be employed.

Namely, the microwave filter of the second embodiment is inserted in the microwave transmission line disposed on the substrate 11, or the microwave filter is merged in the microwave transmission line. The microwave filter of the second embodiment encompasses the lowpass thin film element 18 and the highpass thin film element (21, 22, 23) stacked on the lowpass thin film element. Here, topological distribution of a stacked structure comprised of the lowpass thin film element 18 and highpass thin film element (21, 22, 23) is approximately same in a mirror-image relationship with respect to the median plane VIIIM—VIIIM, the topological distribution is defined on a cross-sectional plane, which is perpendicular to the signal propagation direction.

Other structure and materials are similar to the structure and materials already explained in the first embodiment, and the overlapped description or the redundant description may be omitted in the second embodiment.

Figure 9:
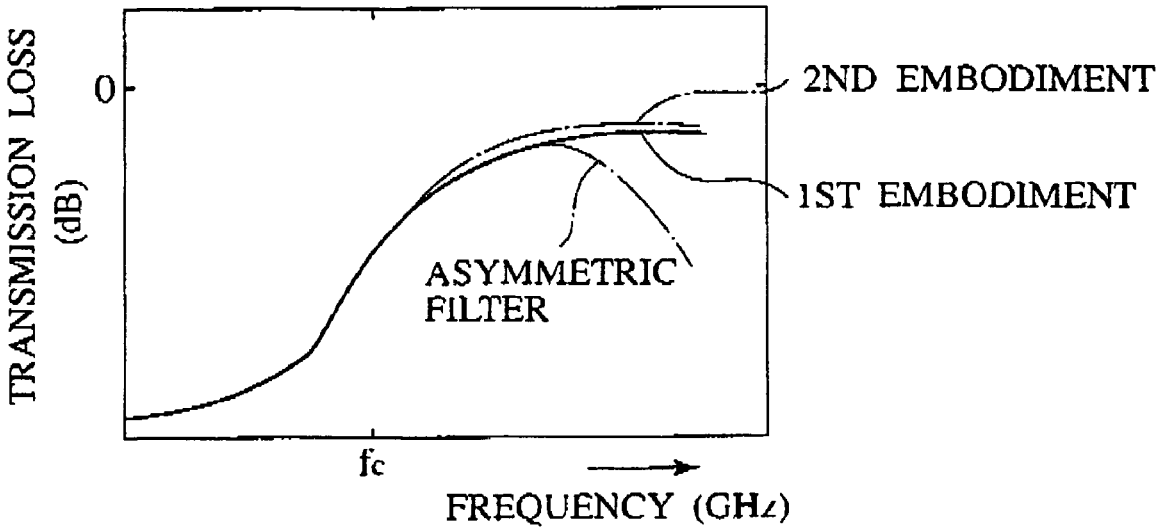
FIG. 9 explains frequency characteristics of the microwave filter according to the second embodiment of the present invention.

Frequency characteristics of the microwave filter having the vertically stacked architecture as shown in FIGS. 8A–8D, in which the capacitor C and the resistive element R are vertically stacked along the direction perpendicular to the surface of substrate 11 is shown in FIG. 9. FIG. 9 further includes the frequency characteristics of the asymmetric microwave filter shown in FIGS. 1A–1C and that of the symmetric microwave filter explained in the first embodiment with FIGS. 2A–2E. As shown in FIG. 9, in a frequency range higher than cut-off frequency fc, the microwave filter according to the second embodiment shows lower transmission loss than that of the first embodiment so as to manifest higher performance. By using vertically stacked architecture for the microwave filter according to the second embodiment, the difference of line widths of the transmission line and width the filter formation portion becomes small, and the discontinuity caused by difference of the line widths of the transmission line and the microwave filter.

Although the illustration is omitted, the microwave filter shown in FIGS. 8A–8D implements similar microwave integrated circuit as shown in FIGS. 5 and 6.

Third Embodiment

Figure 10A:
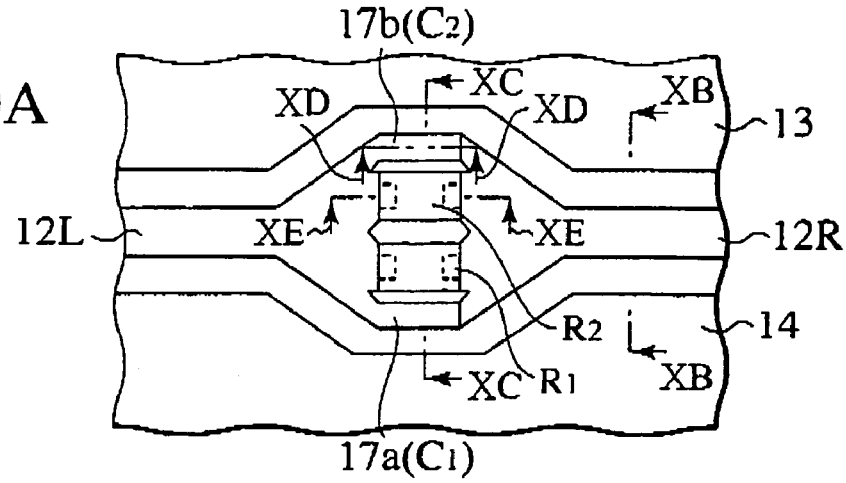
FIGS. 10A–10E are schematic views of a microwave filter according to the third embodiment of the present invention.

The microwave filter according to the third embodiment of the present invention shows a configuration in which total number of the passive circuit elements implementing the lowpass or highpass component of filter, which may be disposed on the substrate 11, is an arbitrary number larger than two. FIG. 10A shows a top plan view of the microwave filter according to the third embodiment, which is distinguishable from the microwave filter according to the first embodiment in that total four passive circuit elements consisting of two capacitors (the capacitive elements) and two resistive elements are used in the configuration.

As shown in FIGS. 10A–10E, the microwave filter according to the third embodiment is integrated in a CPW configuration encompassing a first signal line 12L, a second signal line 12R, a first gland plate 13 and a second gland plate 14, in which the first signal line 12L and the second signal line 12R run between the first gland plate 13 and the second gland plate 14. As shown in FIG. 1A, each of the edges of the first signal line 12L and the second signal line 12R of the CPW forks into four branch lines. Among the four branch lines, a first resistive element R1 serving as a half part of a lowpass component of filter and a second resistive element R2 serving as remaining half part of the lowpass component of filter are interposed in the inner branch lines. Among the four branch lines, a first capacitor (the capacitive element) C1 is interposed in the lower-branch line, the first capacitor C1 serving as a half part of a highpass component of filter. And among the four branch lines, a second capacitor (the capacitive element) C2 is interposed in the upper-branch line, the second capacitor C2 serving as remaining half part of the highpass component of, filter. In this way, a symmetric configuration in which two capacitors C1 and C2 and two resistive elements R1 and R2 are parallel connected is provided. With respect to the central axis of the first signal line 12L and the second signal line 12R, the first resistive element R1 and the second resistive element R2 are disposed in upside down symmetry topology on the plan view of FIG. 10A. Furthermore, with respect to the central axis of the first signal line 12L and the second signal line 12R, the first capacitor (the capacitive element) C1 and the second capacitor (the capacitive element) C2 are disposed in upside down symmetry topology on the plan view of FIG. 10A.

Figure 10B:
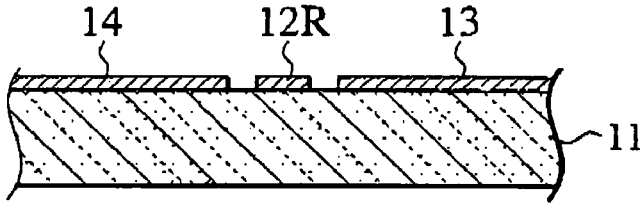
Figure 10C:
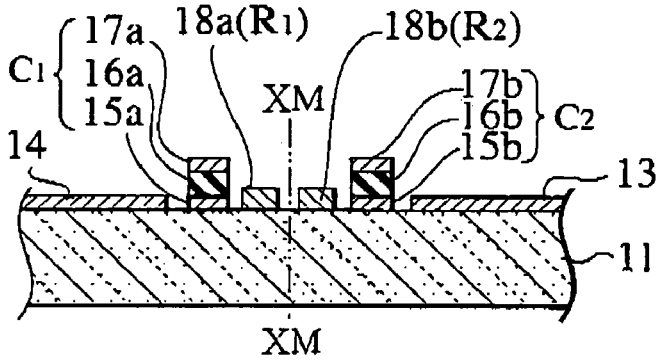

Then, the geometrical configuration illustrated on the cross sectional view as shown in FIG. 10C is symmetry with respect to the median plane XM—XM, which is placed perpendicular to the surface of the substrate 11, the median plane XM—XM includes the central axis of the first signal line 12L and the second signal line 12R. In the geometrical configuration, filter elements C1, C2, R1 and R2 are connected in parallel along the signal propagation direction of the microwave transmission line. Namely, the cross section shown in FIG. 10C is perpendicular to the signal propagation direction along the central axis of the first signal line 12L and the second signal line 12R. The shape and relative position of the filter elements C1 and C2 disposed on the opposite sides of the median plane XM—XM has mirror-image relation along the median plane XM—XM. The shape and relative position of the filter elements R1 and R2 disposed on the opposite sides of the median plane XM—XM has also the mirror-image relation along the median plane XM—XM. In other word, the spatial distribution of the filter elements C1, C2, R1 and R2 is symmetry about the median plane XM—XM. Therefore, the microwave filter according to the third embodiment of the present invention has the symmetric topology with respect to the central axis of the central conducting strip of the CPW.

Figure 10D:
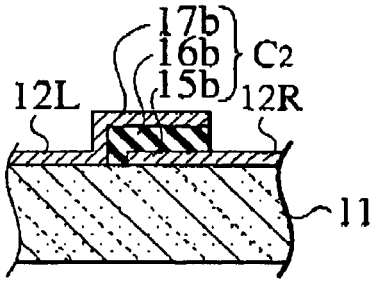
Figure 10E:
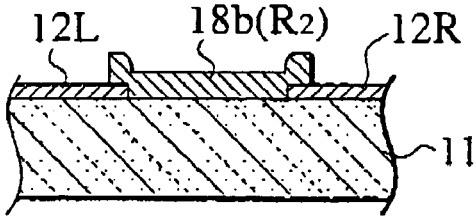

FIG. 10B is a sectional view taken on line XA—XA of FIG. 10A, FIG. 10C is a sectional view taken on line XB—XB of FIG. 10A. Furthermore, FIG. 10D is a sectional view taken on line XC—XC of FIG. 10A, FIG. 10E is a sectional view taken on line XD—XD of FIG. 10A. Similar to the first embodiment, the semiconductor substrate is employed as the substrate 11 in the microwave filter according to the third embodiment. On the semiconductor substrate 11, Au thin films or Al thin films having thickness of 0.1–2 μm are disposed to implement the CPW configuration.

The arrangement of the first lowpass element R1 and second lowpass element R2 is sandwiched by the first highpass element C1 and second highpass element C2 with a gap width provided on both sides of the arrangement of the first lowpass element R1 and second lowpass element R2, respectively. Here, the arrangement of the first lowpass element R1 and second lowpass element R2 is approximately same in the mirror-image relationship with respect to the median plane XM—XM.

As shown in FIGS. 10C and 10D, the second capacitor (the capacitive element) C2 encompasses a bottom electrode 15*b* implemented by an edge of the branch line of the second signal line 12R of the CPW, a top electrode 17*b* implemented by an edge of the branch line of the first signal line 12L of the CPW, and a capacitor dielectric film 16*b* sandwiched in between the bottom electrode 15*b* and top electrode 17*b*, so as to implement a MIM capacitor configuration. For the capacitor dielectric film 16*b*, insulating film such as $SiO_2$ film and $Si_3N_4$ film can be used. As shown in FIG. 10C, the first capacitor (the capacitive element) C1 has the MIM capacitor configuration, encompassing a bottom electrode 15*a*, a top electrode 17*a* and a capacitor dielectric film 16*a* disposed between the bottom electrode 15*a* and the top electrode 17*a*.

On the other hand, a second resistive element R2 is implemented by a second resistor body 18*b* configured to connect an edge of one of the inner branch line of the second signal line 12R of the CPW and an edge of one of the inner branch line of the first signal line 12L of the CPW, as shown in FIG. 10E. As suitable material for the second resistor body 18*b* shown in FIG. 10E, Pt, $Ta_2N$, Ni—Cr alloy can be employed. Although the illustration of a longitudinal sectional view similar to the view shown in FIG. 10E is omitted, but the first resistive element R1 has a same configuration as that of the second resistive element R2, of course. As shown in FIG. 10E, there is a specific contact resistance between the edge of one of the inner branch lines of the second signal line 12R of the CPW and second resistor body 18*b*. In addition, there is a specific contact resistance between the edge of one of the inner branch lines of the first signal line 12L and second resistor body 18*b*. Although the illustration is omitted, there is a specific contact resistance between the edge of other of the inner branch lines of the second signal line 12R and first resistor body 18*a*, and between the edge of other of the inner branch lines of the first signal line 12L and second resistor body 18*a*. In other words the first resistive element R1 and the second resistive element R2 have an intrinsic contact resistance defined by fabrication process for the first resistive element R1 and the second resistive element R2. Therefore, by choosing the conditions of the fabrication process, a larger ohmic contact value can be achieved than the case implemented by one resistive element. In other words, by using the first resistive element R1 and the second resistive element R2, the same ohmic contact value can be achieved with smaller occupying area than the case implemented by one resistive element, by choosing the conditions of the fabrication process.

Although the illustration is omitted, the microwave filter shown in FIGS. 10A–10E implements similar microwave integrated circuit as shown in FIGS. 5 and 6.

Fourth Embodiment

Figure 11A:
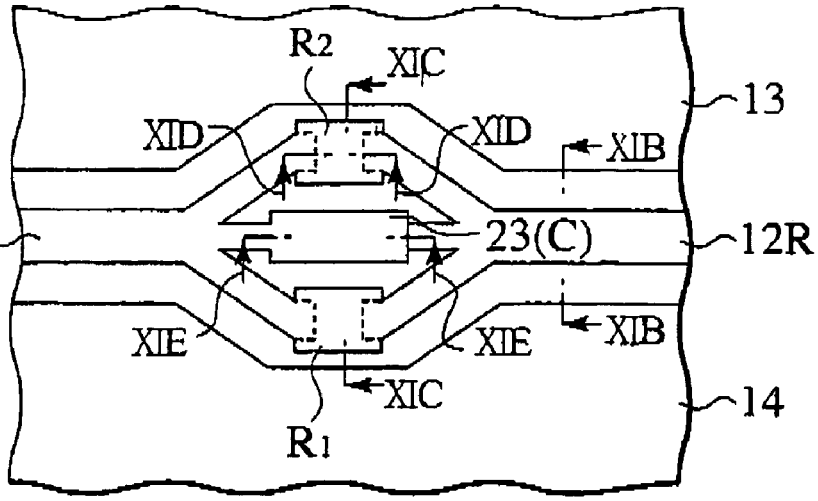
FIGS. 11A–11E are schematic views of a microwave filter according to a fourth embodiment of the present invention.

As shown in FIGS. 11A–11E, the microwave filter according to fourth embodiment is integrated in a CPW configuration encompassing a first signal line 12L, a second signal line 12R, a first gland plate 13 and a second gland plate 14, in which the first signal line 12L and the second signal line 12R run between the first gland plate 13 and the second gland plate 14. As shown in FIG. 11A, each of the edges of the first signal line 12L and the second signal line 12R of the CPW forks into three branch lines. Among the three branch lines, a capacitor (the capacitive element) C serving as a highpass component of filter is interposed in central-branch line. Among the three branch lines, a first resistive element R1 serving as a half part of a lowpass component of filter is interposed in the lower-branch line. And among the three branch lines, a second resistive element R2 is interposed in the upper-branch line, the second resistive element R2 serves as remaining half part of the lowpass component of filter. In this way, a symmetric configuration in which one capacitor C and two resistive elements R1 and R2 are parallel connected is provided. With respect to the central axis of the first signal line 12L and the second signal line 12R, the first resistive element R1 and the second resistive element R2 are disposed in upside down symmetry topology on a plan view of FIG. 11A. Furthermore, on the central axis of the first signal line 12L and the second signal line 12R, the capacitor (the capacitive element) C is disposed.

Figure 11B:
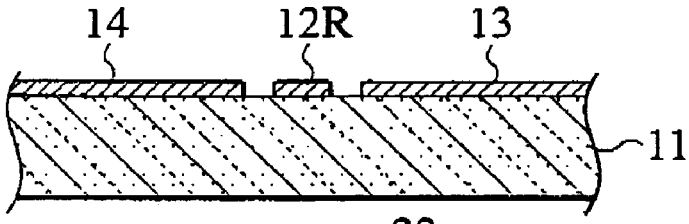
Figure 11C:
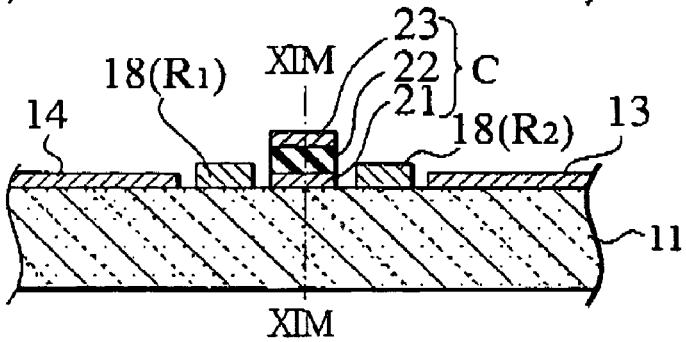

The geometrical configuration illustrated on the cross sectional view as shown in FIG. 11C is symmetry with respect to the median plane XIM—XIM, which is placed perpendicular to the surface of the substrate 11, the median plane XIM—XIM includes the central axis of the first signal line 12L and the second signal line 12R. In the geometrical configuration, filter elements R1, R2 and C are connected in parallel along the signal propagation direction of the microwave transmission line. Namely, the cross section shown in FIG. 11C is perpendicular to the signal propagation direction along the central axis of the first signal line 121 and the second signal line 12R. The shape and relative position of the filter elements R1 and R2 disposed on the opposite sides of the median plane XIM—XIM has mirror-image relation along the median plane XIM—XIM. The topology of the filter element C disposed on the central axis of the first signal line 12L and the second signal line 12R has mirror-image relation with respect to the median plane XIM—XIM. In other word, the spatial distribution of the filter elements R1, R2 and C is symmetry about the median plane XIM—XIM. Therefore, the microwave filter according to the fourth embodiment of the present invention has the symmetric topology with respect to the central axis of the central conducting strip of the CPW.

Figure 11D:
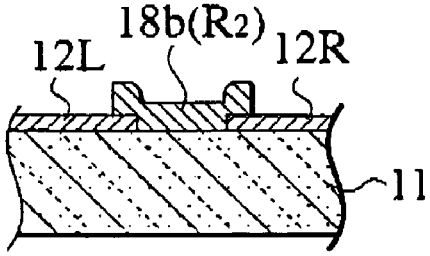
Figure 11E:
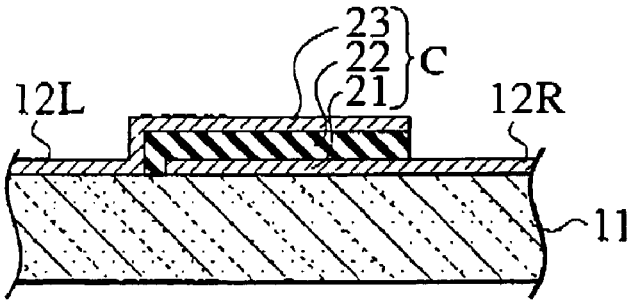

FIG. 11B is a sectional view taken on line XIA—XIA of FIG. 11A, FIG. 11C is a sectional view taken on line XIB—XIB of FIG. 11A. Furthermore, FIG. 11D is a sectional view taken on line XIC—XIC of FIG. 11A, FIG. 11E is a sectional view taken on line XID—XID of FIG. 11A. Similar to the first embodiment, the semiconductor substrate is employed as the substrate 11 in the microwave filter according to the fourth embodiment. On the semiconductor substrate 11, Au thin films or Al thin films having thickness of 0.1–2 μm are disposed to implement the CPW configuration.

As shown in FIGS. 11C and 11D, a second resistive element R2 is implemented by a second resistor body 18*b* configured to connect an edge of lower-branch line of the second signal line 12R of the CPW and an edge of lower-branch line of the first signal line 12L of the CPW. Although the illustration of a longitudinal sectional view similar to the view shown in FIG. 11D is omitted, but the first resistive element R1 has a same configuration as that of the second resistive element R2, of course.

On the other hand, as shown in FIGS. 11C and 11E, the capacitor (capacitive element) C encompasses a bottom electrode 21 implemented by an edge of the central-branch line of the second signal line 12R of the CPW, a top electrode 23 implemented by an edge of the central-branch line of the first signal line 12L of the CPW, and a capacitor dielectric film 22 sandwiched in between the bottom electrode 21 and top electrode 23, so as to implement a MIM capacitor configuration.

In a frequency range lower than or equal to cut-off frequency fc, current flows mainly to the first resistive element R1 and the second resistive element R2, both implementing lowpass component of filters. In an intermediate frequency range higher than cut-off frequency fc, current flows mainly in the capacitor C, serving as the highpass component of filter. In a higher frequency range, in which the edge effect of the RF current becomes remarkable, the RF current flows in the first resistive element R1 and the second resistive element R2 located at both side of the microwave filter, implementing a microwave band pass filter.

Although the illustration is omitted, the microwave filter shown in FIGS. 11A–11E implements similar microwave integrated circuit as shown in FIGS. 5 and 6.

Fifth Embodiment

Figure 12A:
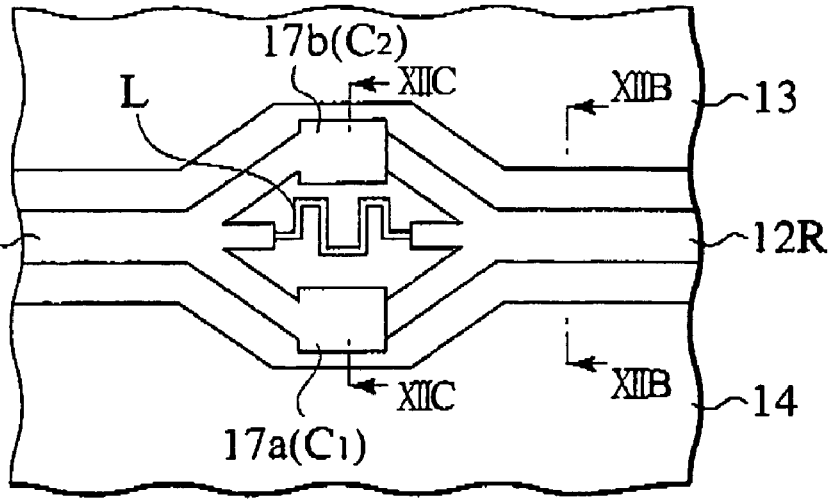
FIGS. 12A–12C are schematic views of a microwave filter according to a fifth embodiment of the present invention.
Figure 12B:
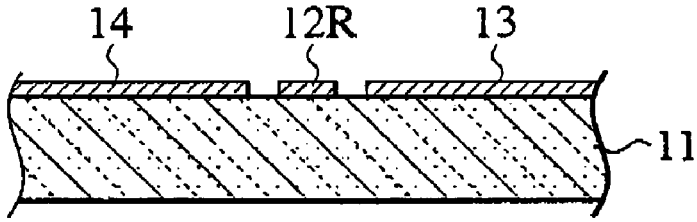
Figure 12C:
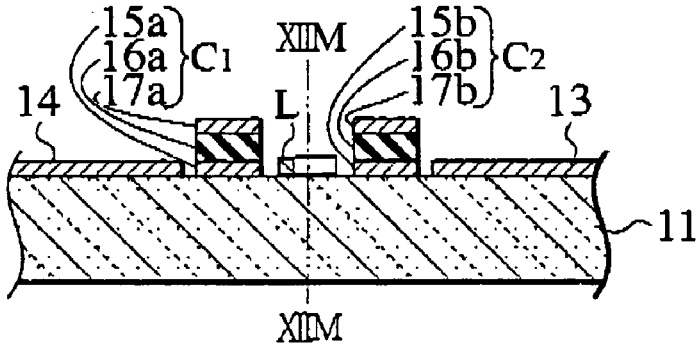

The microwave filter according to the fifth embodiment of the present invention is distinguishable from the microwave filter according to the first embodiment in that the microwave filter encompasses two capacitors (capacitive elements) and one inductor (an inductive element) serving as a non-capacitive element. That is, as shown in FIGS. 12A–12C, the microwave filter according to the fifth embodiment is integrated in a CPW configuration encompassing a first signal line 12L, a second signal line 12R, a first gland plate 13 and a second gland plate 14, in which the first signal line 12L and the second signal line 12R run between the first gland plate 13 and the second gland plate 14. As shown in FIG. 12A, each of the edges of the first signal line 12L and the second signal line 12R of the CPW forks into three branch lines. Among the three branch lines, the inductor (an inductive element) L is interposed in the central-branch line. Among the three branch lines, a first capacitor (a capacitive element) C1 is interposed in the lower-branch line, the first capacitor C1 serves as a half part of a highpass component of filter. And among the three branch lines, a second capacitor (a capacitive element) C2 is interposed in the upper-branch line, the second capacitor C2 serves as remaining half part of the highpass component of filter. In this way, a symmetric configuration in which two capacitors C1 and C2 and one inductor L are parallel connected is provided. With respect to the central axis of the first signal line 12L and the second signal line 12R, the first capacitor (the capacitive element) C1 and the second capacitor (the capacitive element) C2 are disposed in upside down symmetry topology on the plan view of FIG. 12A. Furthermore, on the central axis of the first signal line 12L and the second signal line 12R, the inductor (an inductive element) L implemented by regularly meandering metallic line is disposed. That is, the inductor L has the form of a series of short rectangular turns. The geometrical configuration illustrated on the cross sectional view as shown in FIG. 12C is approximately symmetry with respect to the median plane XIIM—XIIM, which is placed perpendicular to the surface of the substrate 11, the median plane XIIM—XIIM includes the central axis of the first signal line 12L and the second signal line 12R. In the geometrical configuration, filter elements C1, C2 and L are connected in parallel along the signal propagation direction of the microwave transmission line. Namely, the cross section shown in FIG. 12C is perpendicular to the signal propagation direction along the central axis of the first signal line 12L and, the second signal line 12R. The shape and relative position of the filter elements C1 and C2 disposed on the opposite sides of the median plane XIIM—XIIM has mirror-image relation along the median plane XIIM—XIIM. The topology of the filter element L disposed zigzag on the central axis of the first signal line 12L and the second signal line 12R can be regarded as a mirror-image relation with respect to the median plane XIIM—XIIM. In other word, the spatial distribution of the filter elements C1, C2 and L is quasi-symmetry about the median plane XIIM—XIIM. Therefore, the microwave filter according to the fifth embodiment of the present invention has the quasi-symmetric topology with respect to the central axis of the central conducting strip of the CPW.

FIG. 12B is a sectional view taken on line XIIA—XIIA of FIG. 12A, FIG. 12C is a sectional view taken on line XIIB—XIIB of FIG. 12A. The structures and materials of the first capacitor C1 and the second capacitor C2 are very similar to the structures and materials already explained in the first embodiment, and the overlapped description or the redundant description may be omitted in the fifth embodiment. On the other hand, the inductor (the inductive element) L as the non-capacitive element is implemented by a configuration similar to the resistive element R explained in the microwave filter according to the first embodiment substantially. That is the inductor L is implemented by a low resistivity metallic material configured to connect an edge of the central-branch line of the second signal line 12R of the CPW and an edge of the central-branch line of the first signal line 12L of the CPW, as shown in FIG. 12A. As suitable material for the low resistivity metallic material. Au thin film or Al thin film can be employed. Although meander line topology is shown in FIG. 12A, a straight-line topology can be employed for the inductor L. Even if the inductor L has the same line width with those of the first signal line 12L and the second signal line 12R substantially, it may be understood that the inductor can manifests the non-capacitive characteristics.

Consequently, as shown in FIGS. 12A–12C, the inductor (the inductive element) serving as the non-capacitive element and the lowpass component of filter, and the microwave filter can be implemented.

Although the illustration is omitted, the microwave filter shown in FIGS. 12A–12C implements similar microwave integrated circuit as shown in FIGS. 5 and 6.

Sixth Embodiment

Figure 13A:
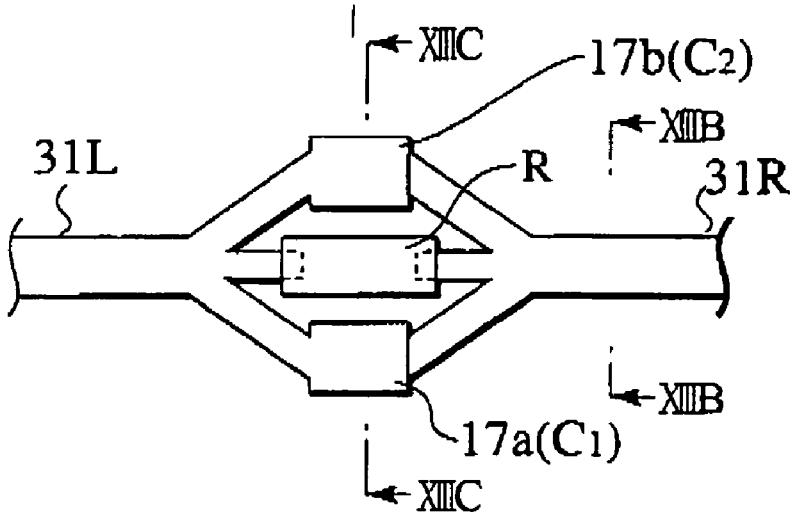
FIGS. 13A–13C are schematic views of a microwave filter according to a sixth embodiment of the present invention.
Figure 13B:
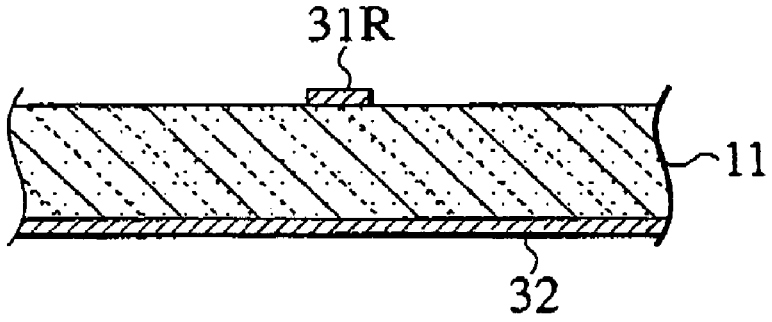
Figure 13C:
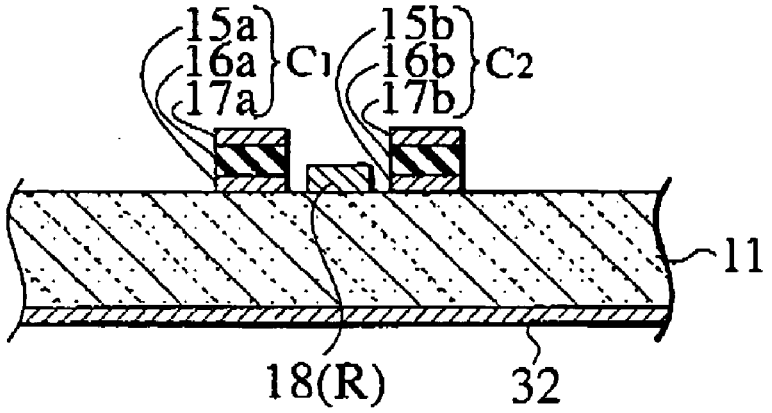

As shown in FIGS. 13A–13C, the microwave filter according to the sixth embodiment is integrated in a microstrip line configuration encompassing a first signal line 31L, a second signal line 31R, a gland plate 32, and an insulating substrate 11, which is sandwiched between the first signal line 31L and the gland plate 32, and is sandwiched between the second signal line 31R and the gland plate 32. As shown in FIG. 13A, each of the edges of the first signal line 31L and the second signal line 31R of the microstrip forks into three branch lines. Among the three branch lines, a resistive element R serving as a lowpass component of filter is interposed in the central-branch lines. Among the three branch lines, a first capacitor (a capacitive element) C1 is interposed in the lower-branch line, the first capacitor C1 serves as a half part of a highpass component of filter. And among the three branch lines, a second capacitor (a capacitive element) C2 is interposed in the upper-branch line, the second capacitor C2 serves as remaining half part of the highpass component of filter. In this way, a symmetric configuration in which two capacitors C1 and C2 and one resistive element R are parallel connected is provided. With respect to the central axis of the first signal line 31L and the second signal line 31R, the first capacitor (the capacitive element) C1 and the second capacitor (the capacitive element) C2 are disposed in upside down symmetry topology. Furthermore, on the central axis of the first signal line 31L and the second signal line 31R, the resistive element R is disposed. Therefore, the microwave filter according to the sixth embodiment of the present invention has the symmetric topology with respect to the central axis of the central conducting strip of the microstrip. For example, line width of the first signal line 31L and the second signal line 31R of the microstrip line and the second signal line 12R may be chosen as approximately 20 μm, and each of three branch lines as approximately 10 μm.

FIG. 13B is a sectional view taken on line XIIIA—XIIIA of FIG. 13A, FIG. 13C is a sectional view taken on line XIIIB—XIIIB of FIG. 13A. Similar to the first embodiment, a semi-insulating semiconductor substrate can be employed as the insulating substrate 11 in the microwave filter according to the sixth embodiment. On the insulating substrate 11, Au thin films or Al thin films having thickness of 0.1–2 μm are disposed to implement the microstrip line configuration.

As shown in FIG. 13C, the structures and materials of the first capacitor C1 and the second capacitor C2 are very similar to the structures and materials already explained in the first embodiment, and the overlapped description or the redundant description may be omitted in the sixth embodiment. Furthermore, the structures and materials of the resistive element R is very similar to the structure and material already explained in the first embodiment, and the overlapped description or the redundant description may be omitted in the sixth embodiment.

With the configuration, in which two capacitors C1 and C2 and one resistive element R are integrated in the microstrip line, in a frequency range higher than cut-off frequency fc, the microwave filter according to the sixth embodiment shows the similar frequency characteristics of the microwave filter as shown in FIG. 3, manifesting the lower transmission loss so as to achieve the higher performance.

Although the illustration is omitted, the microwave filter shown in FIGS. 13A–13C implements similar microwave integrated circuit as shown in FIGS. 5 and 6.

Seventh Embodiment

Figure 14A:
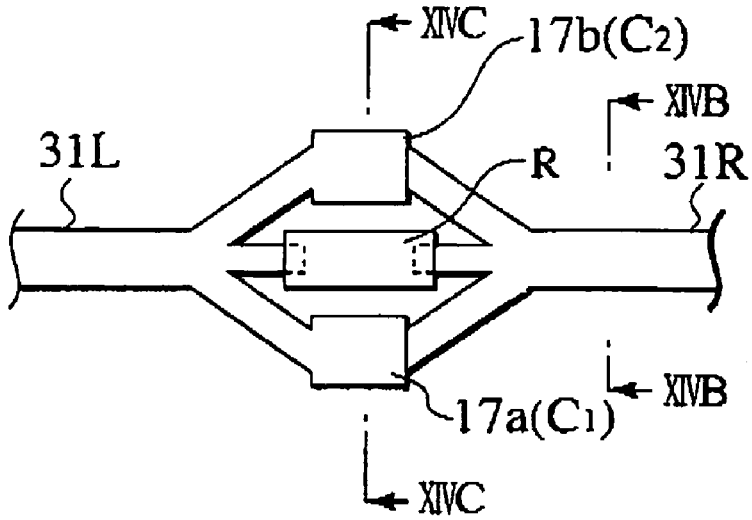
FIGS. 14A–14C are schematic views of a microwave filter according to a seventh embodiment of the present invention.
Figure 14B:
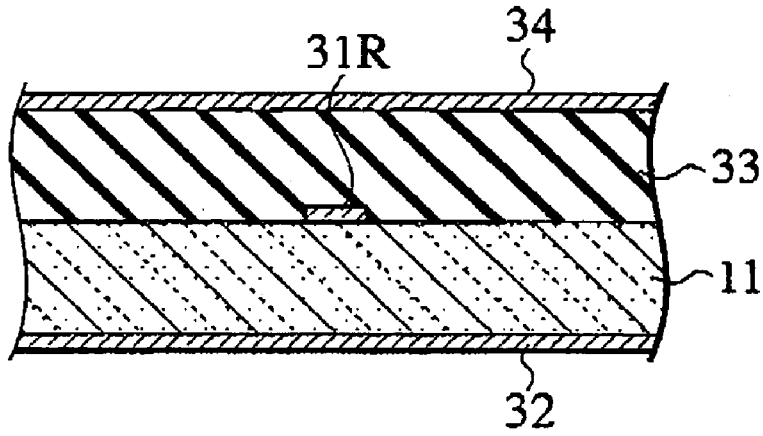
Figure 14C:
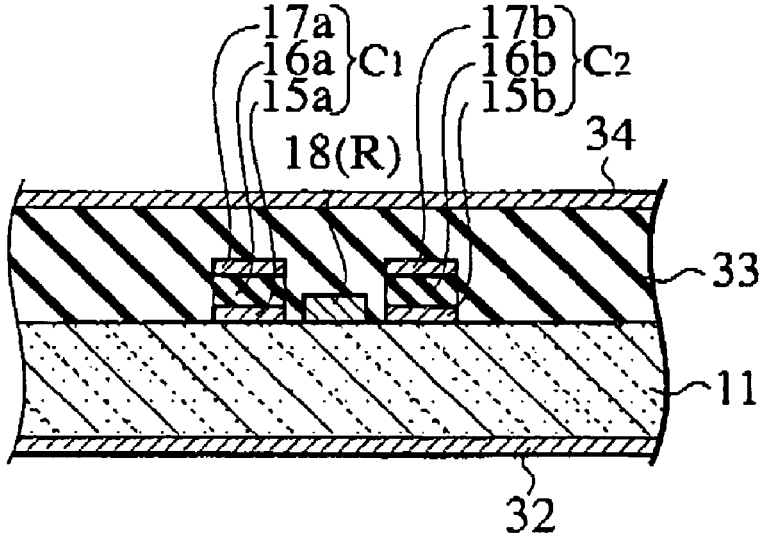

As shown in FIGS. 14A–14C, the microwave filter according to the seventh embodiment is integrated in a strip line configuration encompassing an insulating substrate 11, a first signal line 31L disposed on the insulating substrate 11, a second signal line 31R disposed on the insulating substrate 11, a bottom gland plate 32 disposed under the insulating substrate 11, a dielectric layer 33 disposed on the first signal line 31L and the second signal line 31R. Similar to the embodiments pertaining to the CPW configuration, a semi-insulating semiconductor substrate can be employed as the insulating substrate 11 in the microwave filter according to the seventh embodiment. On the insulating substrate 11, a thin film or Al thin film having thickness of 0.1–2 μm is delineated so as to form the first signal line 31L and the second signal line 31R. On the first signal line 31L and the second signal line 31R, the dielectric layer 33 made of silicon oxide film, semi-insulating semiconductor layer or ceramics layer is stacked so as to implement the strip line configuration.

As shown in FIG. 14A, each of the edges of the first signal line 31L and the second signal line 31R of the microstrip forks into three branch lines. Among the three branch lines, a resistive element R serving as a lowpass component of filter is interposed in the central-branch lines. Among the three branch lines, a first capacitor (the capacitive element) C1 is interposed in the lower-branch line, the first capacitor C1 serves as a half part of a highpass component of filter. And among the three branch lines, a second capacitor (the capacitive element) C2 is interposed in the upper-branch line, the second capacitor C2 serves as remaining half part of the highpass component of filter. In this way, a symmetric configuration in which two capacitors C1 and C2 and one resistive element R are parallel connected is provided. With respect to the central axis of the first signal line 31L and the second signal line 31R, the first capacitor (the capacitive element) C1 and the second capacitor (the capacitive element) C2 are disposed in upside down symmetry topology. Furthermore, on the central axis of the first signal line 31L and the second signal line 31R, the resistive element R is disposed. Therefore, the microwave filter according to the seventh embodiment of the present invention has the symmetric topology with respect to the central axis of the central conducting strip of the microstrip.

FIG. 14B is a sectional view taken on line XIVA—XIVA of FIG. 14A, FIG. 14C is a sectional view taken on line XIVB—XIVB of FIG. 14A. As shown in FIG. 14C, the structures and materials of the first capacitor C1 and the second capacitor C2 are very similar to the structures and materials already explained in the first embodiment, and the overlapped description or the redundant description may be omitted in the seventh embodiment. Furthermore, the structures and materials of the resistive element R is very similar to the structure and material already explained in the first embodiment, and the overlapped description or the redundant description may be omitted in the seventh embodiment.

With the configuration, in which two capacitors C1 and C2 and one resistive element R are integrated in the strip line, in a frequency range higher than cut-off frequency fc, the microwave filter according to the seventh embodiment shows the similar frequency characteristics of the microwave filter as shown in FIG. 3, manifesting the lower transmission loss so as to achieve the higher performance.

Although the illustration is omitted, the microwave filter shown in FIGS. 14A–14C implements similar microwave integrated circuit as shown in FIGS. 5 and 6.

Other Embodiments

Various modifications will become possible for those skilled in the art after receiving the leaching of the present disclosure without departing from the scope thereof.

For example, CPW, microstrip line and strip line configurations were described as examples of the microwave transmission lines in the explanations of the first to seventh embodiments, but features of the present invention can also apply to thin film microstrip line, reverse thin film microstrip line or other microwave transmission lines. Further, as long as the scope of the invention does not deviate from subjects of the present invention, miscellaneous modification can be executed.

In addition, in the description of the first embodiment, the microwave integrated circuit using HEMTs was described as an example, but features of the present invention can be applied to another microwave integrated circuits using any kind of active elements. For example, metal-semiconductor (MES) field effect transistors (FETs) or insulated gate FETs can be employed. In addition, vertical transistors such as heterostructure bipolar transistors (HBTs) or high frequency transistors such as static induction transistors (SITs) can be employed. Further, the semiconductor substrate 11 is not limited to the compound semiconductor substrate 11 such as GaAs and InP, it can use single element semiconductor substrate 11 such as silicon (Si). For example, features of the present invention can be implemented by MOSFET formed on silicon substrate 11 so as to provide high frequency amplification circuitry.

In this way the present invention includes various embodiments, which are not described here. Thus, the present invention includes various embodiments and modifications and the like which are not detailed above.

What is claimed is:

1. A microwave filter disposed on a substrate configured to connect a first microwave transmission line to a second microwave transmission line, configured such that a signal propagates from the first to second microwave transmission lines, comprising:

a capacitive component disposed in a first symmetrical configuration with respect to a longitudinal median plane placed perpendicular to a surface of the substrate, the longitudinal median plane includes a central axis of the first and second microwave transmission lines; and a resistive component connected parallel with the capacitive component, the resistive component being disposed in a second symmetrical configuration with respect to the longitudinal median plane, wherein the first and second symmetrical configurations are defined on a cross-sectional plane perpendicular to the central axis.

2. The microwave filter of claim 1, wherein the capacitive and the resistive components are vertically aligned along the longitudinal median plane.

3. The microwave filter of claim 1, wherein the capacitive component comprises a plurality of capacitive elements laterally arranged along the surface of the substrate, configured such that the geometrical configuration of the capacitive elements is symmetrical with respect to the longitudinal median plane.

4. The microwave filter of claim 3, wherein the capacitive and resistive components are laterally aligned along the surface of the substrate such that the resistive component is disposed to an inner side of the geometrical configuration of the capacitive elements.

5. The microwave filter of claim 4, wherein side surfaces of the resistive component are contacted with side surfaces of the capacitive elements, achieving electrical isolation between the resistive component and the capacitive elements.

6. The microwave filter of claim 1, wherein the resistive component comprises a plurality of resistive elements laterally arranged along the surface of the substrate, configured such that the geometrical configuration of the resistive elements is symmetrical with respect to the longitudinal median plane.

7. The microwave filter of claim 6, wherein the capacitive and resistive components are laterally aligned along the surface of the substrate such that the capacitive component is disposed to an inner side of the geometrical configuration of the resistive elements.

8. A microwave filter inserted in a microwave transmission line disposed on a substrate, comprising:

a capacitive component disposed on the substrate; and a resistive component disposed on the substrate, wherein topological distributions of the capacitive and resistive components of filter are approximately same in a mirror-image relationship with respect to a longitudinal median plane, the longitudinal median plane placed perpendicular to a surface of the substrate, the longitudinal median plane includes a central axis of the microwave transmission line along a signal propagation direction, and the topological distributions are defined on a cross-sectional plane which is perpendicular to the signal propagation direction.

9. A microwave filter comprised of thin film elements, the microwave filter inserted in a microwave transmission line disposed on a substrate, comprising:

first and second capacitive elements disposed on opposite sides of a longitudinal median plane, respectively, the longitudinal median plane placed perpendicular to a surface of the substrate, the longitudinal median plane including a central axis of the microwave transmission line along a signal propagation direction; and a resistive element disposed on the central axis of the microwave transmission line, being sandwiched by the first and second capacitive elements with a gap width provided on both sides of the resistive element, respectively;

wherein a topological distribution of the resistive element is approximately same in a mirror-image relationship with respect to the longitudinal median plane on a cross-sectional plane, the cross-sectional plane being defined as a plane perpendicular to the signal propagation direction.

10. A microwave filter comprised of thin film elements, the microwave filter inserted in a microwave transmission line disposed on a substrate, comprising:

first and second capacitive elements disposed on opposite sides of a longitudinal median plane, respectively, the longitudinal median plane placed perpendicular to a surface of the substrate, the longitudinal median plane including a central axis of the microwave transmission line along a signal propagation direction; and first and second resistive elements disposed on the opposite sides of the longitudinal median plane, respectively, an arrangement of the first and second resistive elements being sandwiched by the first and second capacitive elements with a gap width provided on both sides of the arrangement of the first and second resistive elements, respectively;

wherein the arrangement of the first and second resistive elements is approximately same in a mirror-image relationship with respect to the longitudinal median plane on a cross-sectional plane, the cross-sectional plane being defined as a plane perpendicular to the signal propagation direction.

11. A microwave filter comprised of thin film elements, the microwave filter inserted in a microwave transmission line disposed on a substrate, comprising:

first and second resistive elements disposed on opposite sides of a longitudinal median plane, respectively, the longitudinal median plane placed perpendicular to a surface of a substrate, the longitudinal median plane including a central axis of the microwave transmission line along a signal propagation direction; and a capacitive element disposed on the central axis of the microwave transmission line, being sandwiched by the first and second resistive elements with a gap width provided on both sides of the capacitive element, respectively;

wherein a topological distribution of the capacitive element is approximately same in a mirror-image relationship with respect to the longitudinal median plane on a cross-sectional plane, the cross-sectional plane being defined as a plane perpendicular to the signal propagation direction.

12. A microwave filter for insertion in a microwave transmission line disposed on a substrate, comprising:

a resistive thin film element and a capacitive thin film element stacked on the resistive thin film element, wherein a topological distribution of a stacked structure comprised of the resistive and capacitive thin film elements is approximately same in a mirror-image relationship with respect to a median plane, the median plane being perpendicular to a surface of the substrate, including a central axis of the microwave transmission line along a signal propagation direction, the topological distribution being defined on a cross-sectional plane which is perpendicular to the signal propagation direction.

13. A microwave integrated circuit comprising:

a substrate;

a first microwave transmission line implemented by the substrate;

a second microwave transmission line implemented by the substrate, configured such that a signal propagates from the first to the second microwave transmission lines;

a capacitive component disposed in a symmetrical configuration with respect to a longitudinal median plane perpendicular to a surface of the substrate, the longitudinal median plane including a central axis of the first and second microwave transmission lines, the capacitive component being disposed on the substrate so that the first microwave transmission line is connected to the second microwave transmission line; and a resistive component connected parallel with the capacitive component, the resistive component being disposed in a symmetrical configuration with respect to the longitudinal median plane, the resistive component being disposed on the substrate so that the first microwave transmission line is connected to the second microwave transmission line.

14. The microwave integrated circuit of claim 13, further comprising an active element integrated on the substrate so that the signal is supplied from the second microwave transmission line to the active element.

15. The microwave integrated circuit of claim 13, wherein the substrate is formed of a material selected from the group consisting of a semi-insulating semiconductor substrate, a ceramic substrate, and an insulating substrate.

16. The microwave integrated circuit of claim 13, wherein the substrate is formed of a material selected from the group consisting of silicon, gallium arsenide, indium phosphide, alumina, aluminum nitride, beryllia, epoxy resin reinforced by glass fiber, a laminate material consisting of epoxy resin, and glass fiber.

17. A microwave integrated circuit comprising:

a substrate;

first and second signal lines disposed on the substrate;

a bottom gland plate disposed under the substrate;

a highpass component of a filter disposed in a symmetrical configuration with respect to a median plane placed perpendicular to the surface of the substrate, including a central axis of the first and second signal lines, the highpass component being disposed on the substrate so that the first signal line is connected to the second signal line;

a lowpass component of the filter connected parallel with the highpass component, the lowpass component being disposed in a symmetrical configuration with respect to the median plane, the lowpass component being disposed on the substrate so that the first signal line is connected to the second signal line; and a dielectric layer disposed on the first signal line, the second signal line, the highpass component of filter, and the lowpass component of filter.

18. The microwave integrated circuit of claim 17, further comprising a top gland plate disposed on the dielectric layer, wherein the substrate, the first signal line, the bottom gland plate, the dielectric layer, and the top gland plate implement a first strip line, and the substrate, the second signal line, the bottom gland plate, the dielectric layer, and the top gland plate implement a second strip line.

19. The microwave integrated circuit of claim 17, wherein both of facing edges of the first and second signal lines fork into a plurality of branch lines, respectively.

20. The microwave integrated circuit of claim 17, wherein the substrate is formed of an insulating substrate.

* * * * *